US008043134B2

(12) United States Patent
Krah

(10) Patent No.: US 8,043,134 B2
(45) Date of Patent: Oct. 25, 2011

(54) HUMAN POWERED WATERCRAFT

(76) Inventor: Drew Allen Krah, Vashon Island, WA (US)

( * ) Notice: Subject to any disclaimer, the term of this patent is extended or adjusted under 35 U.S.C. 154(b) by 134 days.

(21) Appl. No.: 12/384,599

(22) Filed: Apr. 7, 2009

(65) Prior Publication Data

US 2010/0255736 A1 Oct. 7, 2010

(51) Int. Cl.
*B63H 16/18* (2006.01)

(52) U.S. Cl. ..... 440/32

(58) Field of Classification Search ..... 440/21, 440/22, 25, 32, 13–16
See application file for complete search history.

(56) References Cited

U.S. PATENT DOCUMENTS

| | | | | |
|---|---|---|---|---|
| 3,154,046 | A * | 10/1964 | McLean | 440/19 |
| 6,022,249 | A * | 2/2000 | Ketterman | 440/13 |
| 6,890,226 | B2 * | 5/2005 | Wang | 440/17 |
| 7,232,350 | B1 * | 6/2007 | Krah | 440/35 |
| 7,267,586 | B1 * | 9/2007 | Murphy | 440/32 |
| 7,637,791 | B2 * | 12/2009 | Ketterman et al. | 440/13 |

* cited by examiner

*Primary Examiner* — Daniel Venne

(57) ABSTRACT

A watercraft having a deck is configured with a first rocker having graspable input arm above-deck and a lower output arm, the first rocker being pivoted to the craft, the output arm connecting a push-bar at a first end and the push-bar having a second end connecting a second rocker, the second rocker having input and output arms, the output arm of the second rocker having a propelling fin, the second rocker being pivoted to the watercraft. The watercraft may have a third rocker, fin, and pivot, and more. Users stand upon deck, grasp the first rocker's input arm and vertically thrust the rocker to propel. The invention further comprises a device for human powered propulsion remove-ably attachable to watercrafts, especially small boats, and surfboards, and for propelling them from a standing position by human power.

17 Claims, 19 Drawing Sheets

FIG 19
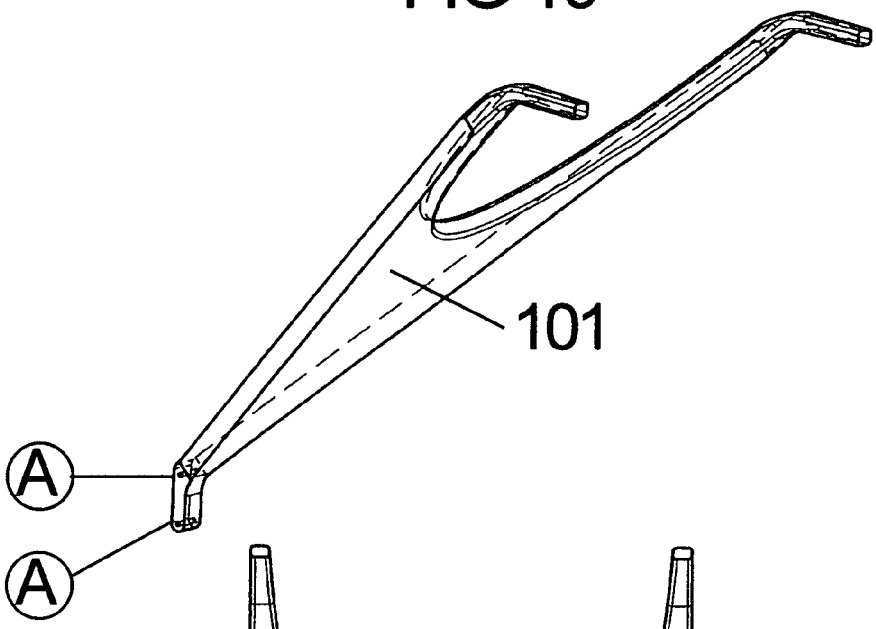
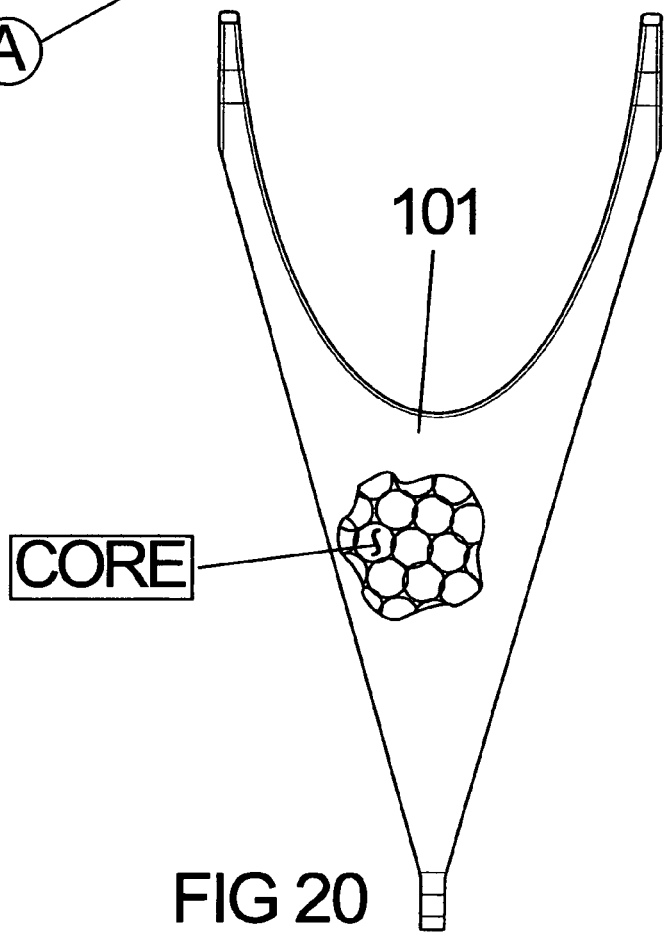
FIG 20
FIG 21
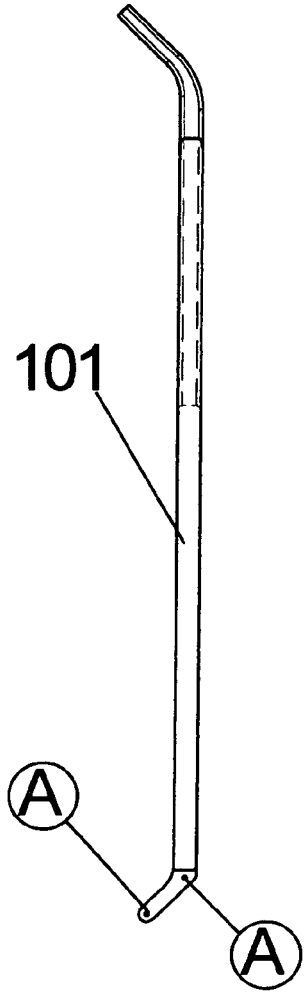

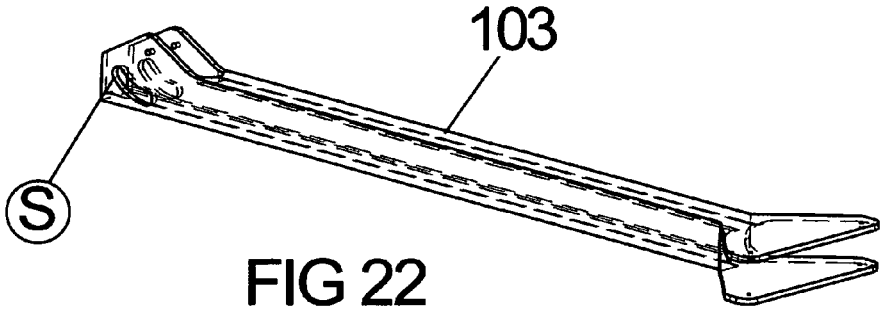
FIG 22
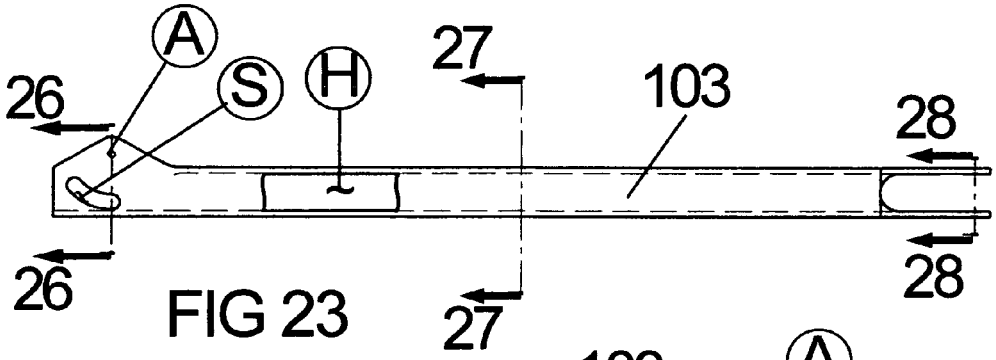
FIG 23
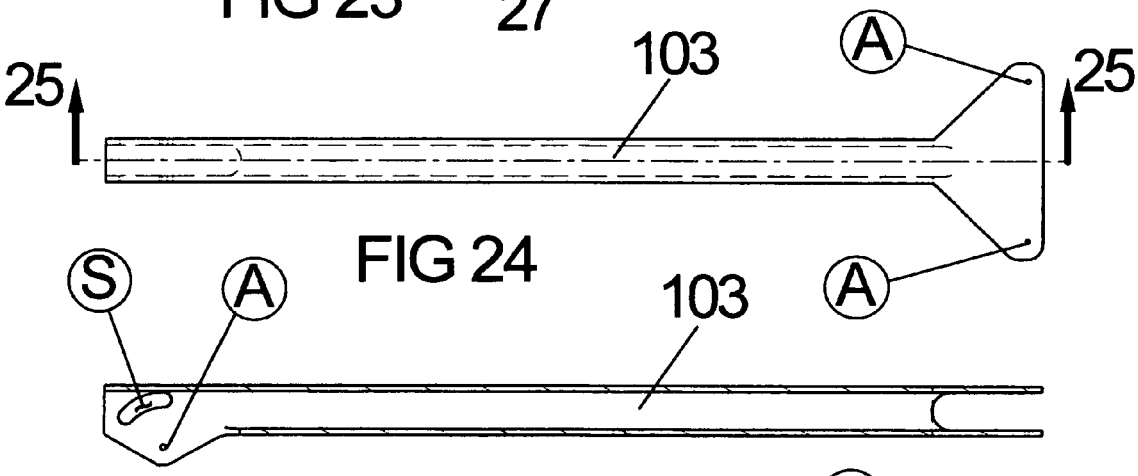
FIG 24
FIG 25
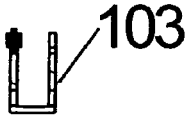
FIG 26
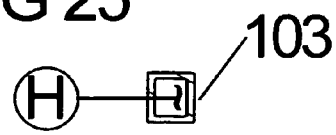
FIG 27
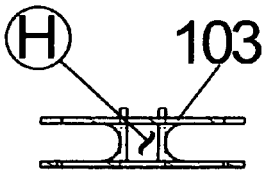
FIG 28

| TRANSLATION INPUT:OUTPUT | L1" | L2" | L3" | L4" | F1# | F2# | F3# | F4X2# | FORCE INPUT:OUTPUT |
|---|---|---|---|---|---|---|---|---|---|
| 1:4 | 60 | 15 | 3 | 24 | 50 | 200 | 100 | 25 | 2:1 |
| 1:4 | 60 | 10 | 1 | 12 | 50 | 300 | 150 | 25 | 2:1 |
| 1:4 | 60 | 5 | 1 | 24 | 50 | 600 | 300 | 25 | 2:1 |
| 1:3 | 60 | 6 | 1 | 15 | 50 | 500 | 250 | 33⅓ | 1½:1 |
| 1:3 | 60 | 6 | 2 | 30 | 50 | 500 | 250 | 33⅓ | 1½:1 |
| 1:2½ | 60 | 5 | 1 | 15 | 50 | 600 | 300 | 40 | 1:8/10 |
| 1:2 | 60 | 5 | 1 | 12 | 50 | 600 | 300 | 50 | 1:1 |
| 1:1 | 60 | 6 | 4 | 20 | 50 | 500 | 250 | 100 | 1:2 |
| 1: 8/10 | 70 | 7 | 3 | 15 | 50 | 500 | 250 | 125 | 1:2½ |

FIG 49

HUMAN POWERED WATERCRAFT

CROSS-REFERENCE TO RELATED APPLICATIONS

This application is related to application Ser. No. 11/977,224, entitled "Human Powered Watercraft", having a filing date of Oct. 23, 2007, by the present inventor, which is incorporated herein in full by reference.

FEDERALLY SPONSORED RESEARCH

Not Applicable

SEQUENCE LISTING OR PROGRAM

Not Applicable

FIELD OF THE INVENTION

This invention relates generally to human powered watercraft and, specifically, to human powered boats and surfboards and, human powered propulsion devices for watercraft.

BACKGROUND OF THE INVENTION

Rowing shells and row-boats, hand-paddled surfboards and swim-fin powered body-boards, hydrofoil vessels such as "Decavitator" and "Pogofoil", paddled kayaks and canoes, inflatable floatation devices powered by various means, and many foot-pedaled crank-driven boats have been in use for years. Rowing shells are no longer the fastest craft on the water, but, those vessels that offer greater speed generally do so at the cost of seaworthiness, safety of use, and outright dollar cost. World record holder "Decavitator", the output of a team of engineers at MIT, and "Pogofoil" by Parker McCready showed the way for the developers of later hydrofoils, but these latter hydrofoils are rarely seen on even placid bodies of water due to substantial drawbacks of safety and product reliability. While these hydrofoil developers focused on ever finer foils and mechanisms as the key to new speed records; and shell designers focused on smoother lines, stiffer hulls, and weight reductions as the means to higher speed, most were in agreement that planing watercraft are simply too athletically demanding to achieve surpassing speed. An instructor at Delft University-Marine Engineering Institute of the Netherlands states unequivocally that human powered planing craft are not practically achievable. These and other statements by engineering experts have strongly advocated against human powered planing-craft, and for hydrofoil craft as the best way to break speed records. Right or wrong these statements have discouraged investigation into planing craft, and therefore, to invent and develop a human powered planing craft especially as integral to a surfboard goes head-on against the teachings of industry and academia, folklore and popular journalism. Thus, an unmet need exists to address the market desire for a safe, economical, fast, convenient, and fun craft power-able by human exertion, and particularly a craft capable of planing or nearly so by human exertion means alone.

BACKGROUND-DESCRIPTION OF THE PRIOR ART

Krah, U.S. Pat. No. 7,232,350 propels a watercraft by a standing user thrusting a handle of a bar up and down, the bar connecting to a dagger board with a horizontal fin, the fin when not propelling stores in a recess in the watercraft. The '350 patent lead to investigations culminating in U.S. patent application Ser. No. 11/977,224 by Krah. The teachings of the '350 patent are incorporated herein in full by reference. Krah, U.S. patent application Ser. No. 11/977,224 propels a watercraft by horizontal leg thrusts upon pedals attached to cam-plates, the cams of the cam-plates driving fin-bars to deflect propulsion fins and propel the craft. The '224 patent application lead to investigations culminating in this patent application. The teachings of the Ser. No. 11/977,224 patent application are incorporated herein in full by reference. In particular, the open hollow surfboard with the hollow open to the sea of the '224 application is used in this application.

"Decavitator" by Mark Drela, et-al, powers a catamaran configured hydrofoil with a pedal-crank system to rotate an air-propeller to power the craft to a long-standing world-record speed. A concept-prover for hydrofoil craft, it was never intended as a market-maker and no such system has entered the market or could gain acceptance at a cost commensurate with such a prohibitively complex vessel.

Ketterman, U.S. Pat. No. 6,022,249 propels a kayak via foot treadles that drive two flexible fins in opposing directions about the keel of a boat. The system is complex and also subject to damage during beaching of the vessel as the fins are most exposed below the keel and users can forget to stow the system.

McCready, U.S. Pat. No. 6,468,118 propels a hydrofoil comprised of a catamaran float configuration having horizontal hydrofoils forward and stemward beneath the floats and a cable-guyed tubular space-frame structure above the deck from which a standing user pogo-hops to cause the foils to fly. The system is not designed for long duration use but rather as a concept-prover of man-powered hydrofoil flight.

Puzey, U.S. Pat. No. 6,099,369 propels a tricycle configuration with horizontal hydrofoils and a molded unitary floatation body by a bounding up and down motion of the user. The system suffers from the inability to start from the water and is unstable in yaw when in following seas. Also, the float body of the system presents significant mass dampening opposition to the user's bounding motion which limits input to the foils.

Maisonneuve, U.S. Pat. No. 4,464,126 propels a surfboard by thrusting a lever forward and aft from a sitting position to drive a lower fin up and down. The system does not allow the surfer to move about the surfboard and the lower keel structure causes yaw instability with forward motion.

Chen, U.S. Pat. No. 6,468,118 propels a surfboard thru two foot treadles with an up and down leg motion deflecting separate horizontal fins. This system uses foot-stirrups and thereby, attaches the user to the board which is dangerous when the board rolls over and the user fails to exit the pedal stirrups.

Momot, U.S. Pat. No. 4,968,273 propels a surfboard with a single treadle driven fin using weight shifting forward and aft to propel the board. The system has a great deal of exposed mechanical clutter and so is constantly dragging down board speed.

Domancic, U.S. Pat. No. 5,549,491 propels a surfboard or boat by a single treadle driving fins by a lateral, side to side weight shift. This motion is particularly destabilizing to a surfboard rider as the board is narrow and least stable laterally. Malm, U.S. Pat. No. 3,377,977 propels a surfboard by a sculling-sweeping motion of a centrally pivoted oar. The lateral side to side motion of this system too is destabilizing.

Ueno, U.S. Pat. No. 4,936,802 propels a boat by a foot treadle driving a vertical fin to rotate back and forth under the keel about a longitudinal axis of the craft. The fin motion causes the boat to slough sideward without the stabilizing presence of a keel.

Shiraki, U.S. Pat. No. 5,194,024 propels a surfboard via a pedal-crank water-propeller system operated by a recumbently seated rider. This and all recumbent systems impede the operator's ability to react to perturbing waves by limiting all but the users head from counter-reaction. As with other pedal and crank systems, the device is most efficient when one is clipped into the pedals, and, as stated previously, this makes emergency egress problematic and failed attempts at egress potentially fatal.

Gander, U.S. Pat. No. 4,304,555 propels a float device by a foot operated bell crank driven fish-fin. Absent a keel, the vehicle is unstable in yaw when propelled thusly.

Han, U.S. Pat. No. 6,033,276 propels a surfboard via a bell-crank foot operated fish fin. The system causes the board to yaw and has not gained market acceptance.

OBJECTS AND ADVANTAGES

The human powered propulsion devices and human powered watercrafts defined herein have substantial advantages over the prior art including but not limited to the following:

1) Simplicity: The propulsion devices and the watercrafts of the invention are simple having very few components and the components themselves are simple and robust and are manufacture able with simple and standard fabrication techniques.

2) Higher speeds: The present invention by virtue of using the legs and arms for power generation exceeds that power available from the arms only by approaching 6 times. Additionally, the devices and human powered watercraft of the invention pose substantially less fluid and aero-drag surfaces and projections into the fluid streams than other, larger and more complex devices and watercraft; in preferred embodiments, crafts of the invention impose only a hydroplaning surface and driving fins into the sea. The user is also able to continuously adjust her center of gravity to maintain trim with respect to the board's center of buoyancy and hydrodynamic center of lift thus enabling the maintenance of the greatest speed for the most efficient athletic exertion. And, greater acceleration and top-end speed will enable surfers to catch very large waves with no difficulty.

3) Superior visibilities: Powering the system from a standing position allows the user greatly improved visibility to and from other craft.

4) Seaworthiness: The system enables a surfer to power out thru, and over breaking waves and white-water, and, having all extremities in contact with the craft enables very authoritative and confidant response-correction to perturbing waves and other conditions. Also, the system allows the user to continue propelling while riding a wave and so allows the surfer to get a ride on a weak wave where normally a surfer would be unable to continue paddling or riding on a weak and weakening wave. A surfboard powered thusly is far more maneuverable than many other mechanized human powered water craft.

5) Ease of learning: The method of human propulsion upon the surfboard is easy to learn and the user is always free of attachment to both the board and the propulsion device, making the usual splashing about of learning both joyful and safe.

6) Constant motion: The user of the invention can be constantly in motion and, with no extremity remaining in the water, the user is less likely to attract the interest of an ocean predator; if a shark is discovered, the user is able to quickly leave the area.

7) Athlete training: Fitness benefits are derived from the ability to continuously work-out rather than lying or sitting idle in the lineup of surfers.

8) Convenience: Like a standard surfboard, it easily carries under one arm and, it requires no set up time or break-down time. It transports and stores easily like any other surf board and in substantially less space than other human powered watercraft and is transportable on standard automobile surf racks and bike board-racks. The propulsion device easily removes from one watercraft and is re-secured to another craft in moments.

9) Economical manufacture: Low manufacturers cost relative to larger systems simply by virtue of using less material and processing resources and therefore, substantially less consumer expense than other human powered watercraft is possible due to the simplicity and compact size inherent to the invention.

10) Surf-break crowd reduction: Reducing population density of surfers in a given locale is enabled because users of the invention may catch waves-easily at sites unattractive to regular surfers.

11) Ease of maintenance: There are few parts to break down, so maintenance costs are low compared to other human powered watercraft. It is easy to disassemble and service and maintain the static and moving parts. Replace-able parts are simple rockers, push-bars, stator carriage, fins, foils, pivot-fasteners.

12) Rescue patrol craft: Since the craft is nimble and powerful, and allows a user a highly effective in-situ perspective from which to observe near-shore swimmers and surfers, the craft will be beneficial to lifeguards for patrol and rescue.

13) Wear-toughening: The few and simple components of the propulsion device of the invention are easily fitted with bushings and bearings, rub-strips and hardened inserts to toughen the system and protect the components from wear and break-down.

14) Ocean stewardship and ecological benefit: Requiring less material resources to fabricate and enabling a user to go faster and farther by human exertion than other watercraft preserves those unused vital resources; use of the craft in lieu of powered vessels fosters restoration of the greater earth-ocean environment.

15) Safety and self-rescue: Easy to aright if overturned; easy to re-mount; the floatation capacity of the board is always close to the user; the system allows a user to wear a floatation vest while using.

SUMMARY OF THE INVENTION

The present invention is a human powered watercraft and is comprised of a floatation vessel and a propulsion device for humanly powering the watercraft from a standing position by alternating up and down leg, arm, and body thrusts which actuate the propulsion device thru user-grasped handles of a rocker to move a push-bar which can be under the deck of the craft which in turn urges second and third rockers to rotate propulsion fins across the stern of the craft and propel the craft. The term "rocker" as used by applicant is a rocker-arm for a rocking mechanism. The floatation vessel may be an open-hollow surfboard with the hollow open to the sea, as per my invention of Krah, U.S. patent application Ser. No. 11/977,224, incorporated herein by reference; and it may be other watercraft, catamarans being particularly suitable vessels for the invention. The propulsion device of the invention is remove-ably attachable to many watercraft but, particularly surfboards, catamarans, pontoon-boats, outrigger-vessels, and also broad-beamed mono-hull boats. The propulsion device itself is comprised of a four-bar mechanism having a first rocker having input and output arms; a push-bar operatively engaging the output arm of the first-rocker; a second rocker having input and output arms, with the input arm of the second rocker operatively engaging the push-bar at an aft push-bar end; the second rocker has a fin attached the output arm; the second rocker further being pivotally attached to a stator-carriage; the stator-carriage and the first rocker being in pivotal relationship. The first rocker of the removable propulsion device has means for hand-grasping by a user. Preferably, the invention has at least one, but may have two or more rockers having propelling fins. The propulsion device attaches to a watercraft with simple removable nut-and-bolt fasteners, although many other fastening systems are applicable. In a surfboard embodiment, the surfboard has an aft facing hollow below-deck and, a deck recess, and, the hollow and the recess are connected such that the fin-bearing-rockers of the propulsion device and the push-bar may be remove-ably inserted the hollow, while the first rocker and stator-carriage are remove-ably inserted the deck-recess. The first rocker and push-bar may be pivotally-fastened at the output arm of the first rocker, or otherwise operatively engaged for example by a flexible tendon-like means not depicted here. The fin-bearing rockers are then pivotally attached the stator-carriage; these fin-bearing rocker pivot fasteners advantageously also attach the surfboard thereby serving dual purpose as pivot pins and structural attach fasteners. The front end of the propulsion device is then structurally fastened to the surfboard.

The surfboard is suitable for fabrication by roto-molding of plastic, and may also be fabricated by the modern construction technique of laminated fiber-reinforced plastic-resin, and may also be made by artisan-labor in the fashion of ancient Hawaiian solid wood boards, adding aft hollow and deck recess; and the surfboard is especially suitable to fabricate as a hollow wooden hull with stringer and former construction as taught by Duke Kahanamoku in the early $20^{th}$ century; in this case again adding deck recess and aft hollow.

The elements of the propulsion device are likewise suitable for fabrication by many and varied means and from many materials, natural and engineered. The first rocker 101, push-bar 103, rockers 107 and 108, and stator-carriage 105 are optimally made from graphite-fabric-reinforced plastic-resin, or fiberglass and resin, but may also be made from solid woods, laminated ply-woods, and metals. Likewise, the fin carrier 121 and fin carriage 125 are best made from rigid materials as above. The fins of the fin-bearing rockers are suited to fabrication by molding of flexible and resilient polymers, and also rigid polymers; they may be co-molded with rigid portions and flexible portions; and they may be made entirely of rigid materials when comprised as rigid pivotal hydrofoil fins, and may also be comprised as flexible pivoting hydrofoils.

Advantageously, the human powered watercraft and the propulsion devices of my invention include very simple components and very few components which are easily made at low cost. The components are suitable for mutual isolation with the use of standard bushings, hardened inserts, and rub-strips. Bearings of plastic or ceramics being immune from attack by sea-water may be used to reduce friction between elements of the device and the device and vessels receiving the device. Bearings, bushings, and rub-strips are not shown here since these are readily discernible and applied by those of normal skill in the art.

(1) In a preferred embodiment; the invention is comprised of a watercraft having a deck with a rocker-means above-deck, the rocker-means itself having a means for a person to apply forces thru the interface of the hands to the rocker-means; a means to transfer those hand-applied forces sternward to a propulsion means astern; and a propulsion means astern comprising at least one fin at a predetermined angle to horizontal, the system when actuated driving the fin across the stern about a pivot-axis common to the watercraft; and the pivot-axis being oriented at a predetermined angle with respect to horizontal.

(2) In another preferred embodiment, the invention is comprised of a surfboard with a rocker-means above the surfboard deck, the rocker-means itself having means for a person to apply forces thru the interface of the hands to the rocker-means; a means to transfer those hand-applied forces to below the surfboard deck and thru a recess and hollow of the surfboard to a propulsion means astern; and a propulsion means astern comprising at least one fin at a predetermined angle to horizontal and oscillating across the stern of the surfboard about a pivot-axis common to the surfboard and a fin-bearing rocker remove ably receiving the fin; the deck being substantially horizontal and the pivot-axis being oriented at a predetermined angle with respect to the deck of the surfboard.

(3) In still another preferred embodiment the invention is a propulsion device adapted to be remove-ably placed into a watercraft having a deck, the propulsion device including a first-rocker operable by a user above-deck to apply hand-loads into the first-rocker; a means to transfer those loads from the first-rocker to below-deck and astern to a propulsion means; and a propulsion means, the propulsion means comprised of one fin-bearing rocker that when the device is actuated by a user, oscillates the fin across the beam of a watercraft and propels the watercraft.

(4) In yet another preferred embodiment the invention is a device adapted to be remove-ably placed into a watercraft having a deck, said device including a first-rocker operable by a user above-deck by applying hand-loads into the first rocker; a means to transfer those applied loads from the first-rocker to below-deck and astern to a propulsion means; the propulsion means comprised of at least a pair of fin-bearing rockers that oscillate across the beam of the watercraft and propel the watercraft in response to the human forces applied the first-rocker by the user.

Operational Summary

The design of the propulsion device allows the first rocker to stow substantially flat and horizontal upon the deck of a surfboard or other watercraft and so allows the board to be prone-paddled and knee-paddled in addition to the unique standing propulsion method taught herein. To operate the surfboard embodiment from a dead-start in water and with the first rocker stowed upon deck, one prone-paddles in the standard fashion until one has sufficient speed to stably ascend to ones knees where one then knee-paddles until stabilized at maximum knee-paddling speed; the user then places the hands at least partially upon the first rocker and then ascends in the fashion of a squat-thrust, pushing down upon the hands and raising up the upper body, and rotating the legs under the body until the feet are placed upon the deck. With the hands now grasping the handles of the first rocker, the user then stands up and pulls up upon the first rocker handles which rotates the first rocker about a pivot common to the surfboard and the first rocker and rotating an output arm of the first rocker to cause a push-bar to translate aft ward and the push-bar urges the fin-bearing rockers to rotate fins across the stem of the surfboard and propel the surfboard by deflecting the fins. The user can then alternate up and down leg, arm, and body thrusts, always holding in the hands the handles of the first rocker and thereby urge the fins to reciprocate across the stem and propel the craft. Propulsion is achieved both in the opening and the closing of the fins and in vertically up and vertically down exertion by the user upon the first rocker. Other watercraft, for example catamarans are broad-beamed and more stable than a surfboard and a user does not need to prone-paddle or knee-paddle before standing, but is able to simply stand upon deck, grasp the handle of the first rocker 101, and begin pumping to propel the boat. With little training or practice, users can apply loads of 50 pounds, 100 pounds and more into the device and, resulting fin-forces at the stem are determined by the fineness of the mechanism design, its precision of manufacture, stiffness of the fins, cavitation or not of the fins, and other factors. Speed of the craft obtains from available thrust applied against hull resistance. Surfboards, having very little wet surface area, and with fine and smooth lines may be propelled to high speeds by athletes of high relative power to weight ratios especially on days of glassy-smooth water and no wind.

Steering of the surfboard embodiment of the invention is in the normal fashion, by leaning, but also, one can also momentarily pop the propelling fins out of the water and pivot the board to re-orient to a new nautical heading and then continue propelling in the new direction. To pivot-turn the surfboard, a user simply applies upload into the handles of the first rocker until all vertical play is at a stop. Then, the user leans forward slightly and hops up, simultaneously pulling upon the handles and thereby removing the fins from the water, and then bodily pivots himself and the craft before the fins re-enter water. He may then proceed in a new direction.

Watercraft and especially surfboards outfitted with the propulsion device are quite a bit faster than prone-paddled, knee-paddled, and standing paddled surfboards and uniquely enable the ability for the user to apply human power in a balanced and stable, very powerful fashion while still allowing substantial ability to move about the deck to maintain trim. This allows a surfboard powered thusly to be substantially smaller than popular stand-up paddle-boards and so minimizes manufacturing cost while the inherent lightweight of the system enables high speeds and excellent maneuver-ability. The input-output ratios of the propulsion devices of the invention as set forth herein are demonstrated for translational-instantaneous ratios of from 1:8/10 up to 1:4 but these are shown purely for pedagogical purposes and infinitely other ratios are obtainable according to the preferences of the designer as driven by preferred use and vehicle size and component material and cost considerations.

The invention is applicable to watercraft generally, including boats of all kinds and particularly catamarans, but is especially noteworthy as applied to a surfboard for standing propulsion. The craft is suitable for use by lifeguards and athletes, beachgoers and surfers, and is suitable for use on small and large bodies of water and is especially advantageous where petrol-powered craft are not allowed.

The novel design of this invention may be understood by reference to the accompanying drawings in which.

Figure 3:
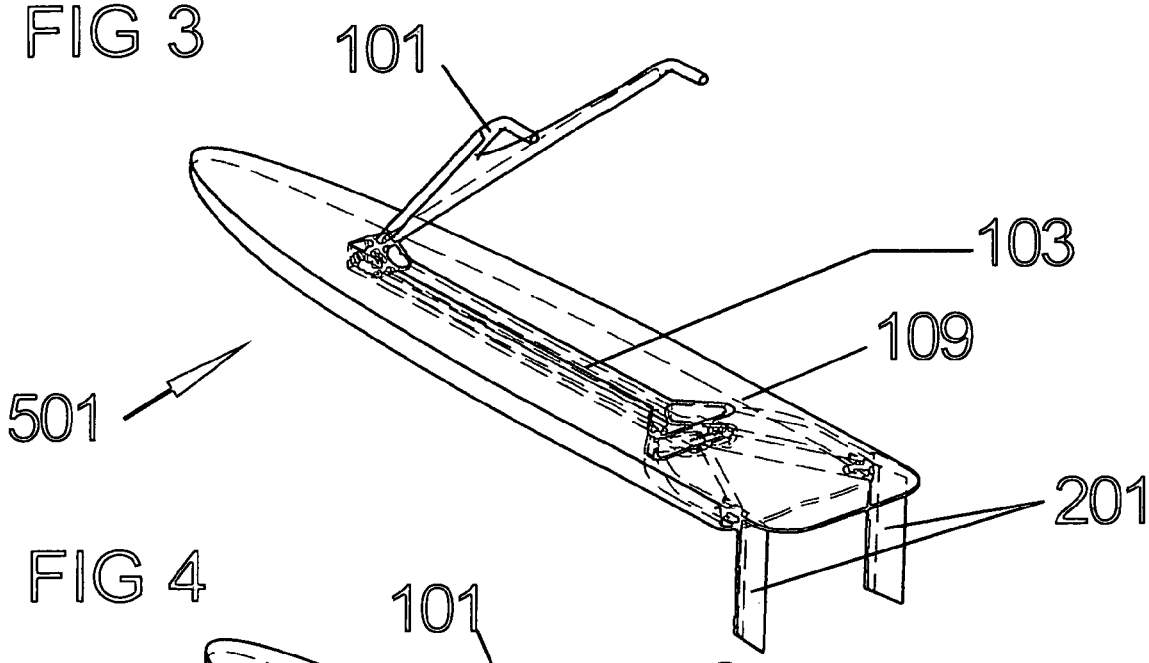
Figure 4:
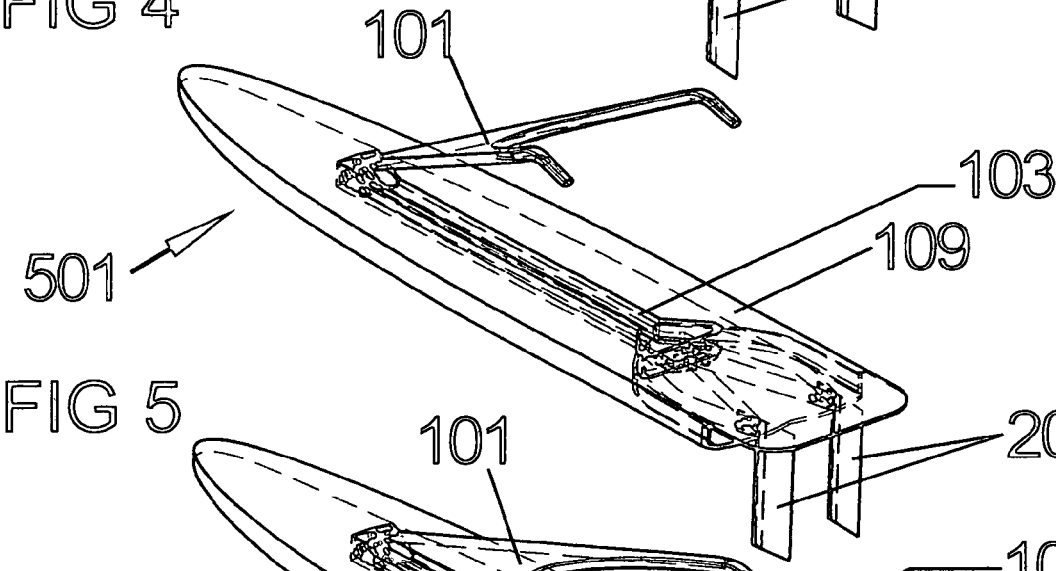
Figure 5:
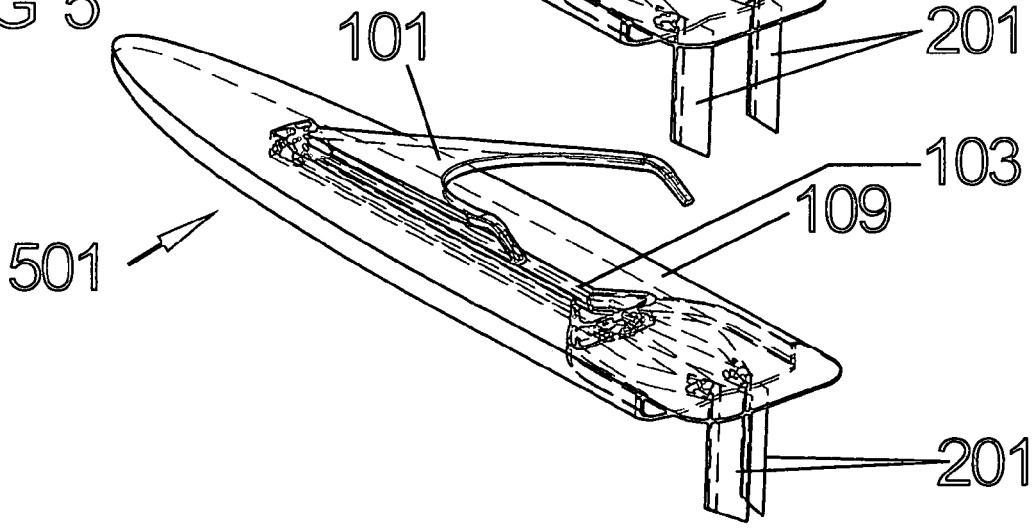

FIGS. 3, 4, and 5 are isometric views showing the surfboard embodiment and the first rocker in different positions of actuation, and show the fins of the propulsion system at different positions of actuation corresponding to the particular first rocker position.

Figure 6:
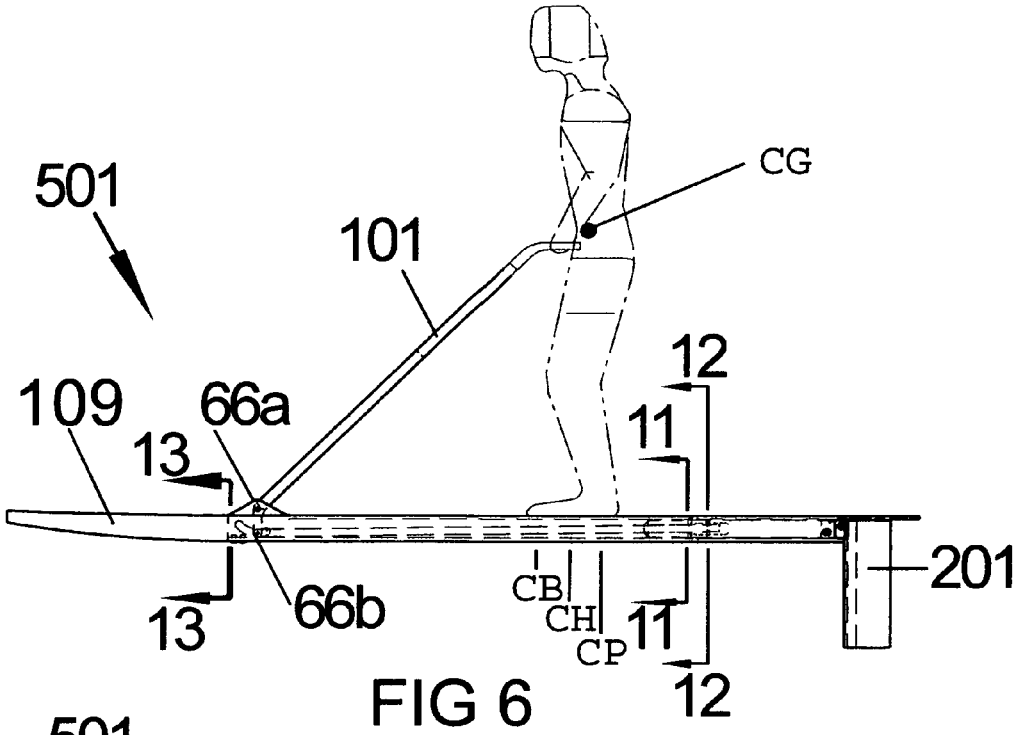
Figure 7:
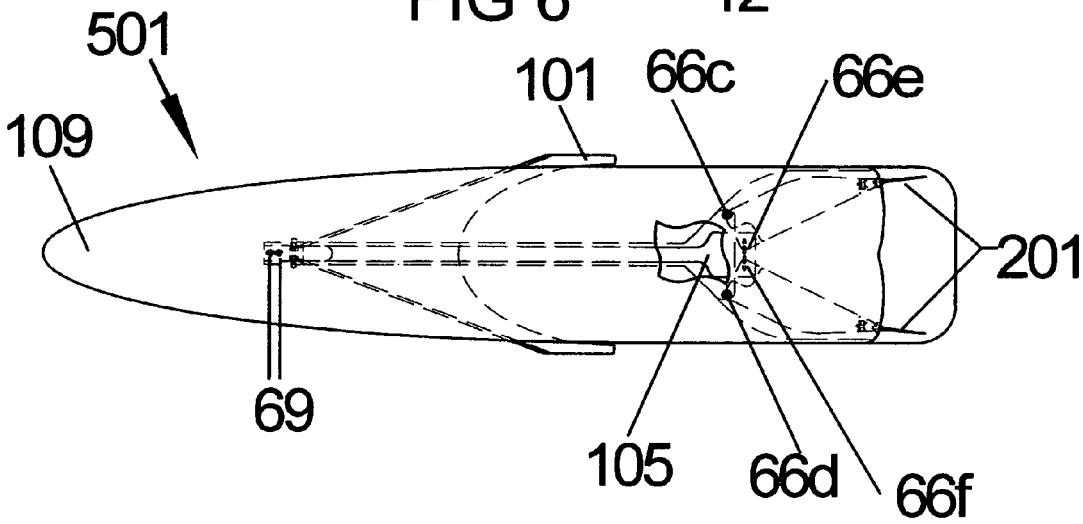

FIGS. 6 and 7 show side and bottom views of the surfboard embodiment of the invention.

FIGS. 8, 9, 10, 11, 12, and 13 show section views of the surfboard embodiment of the invention.

Figure 14:
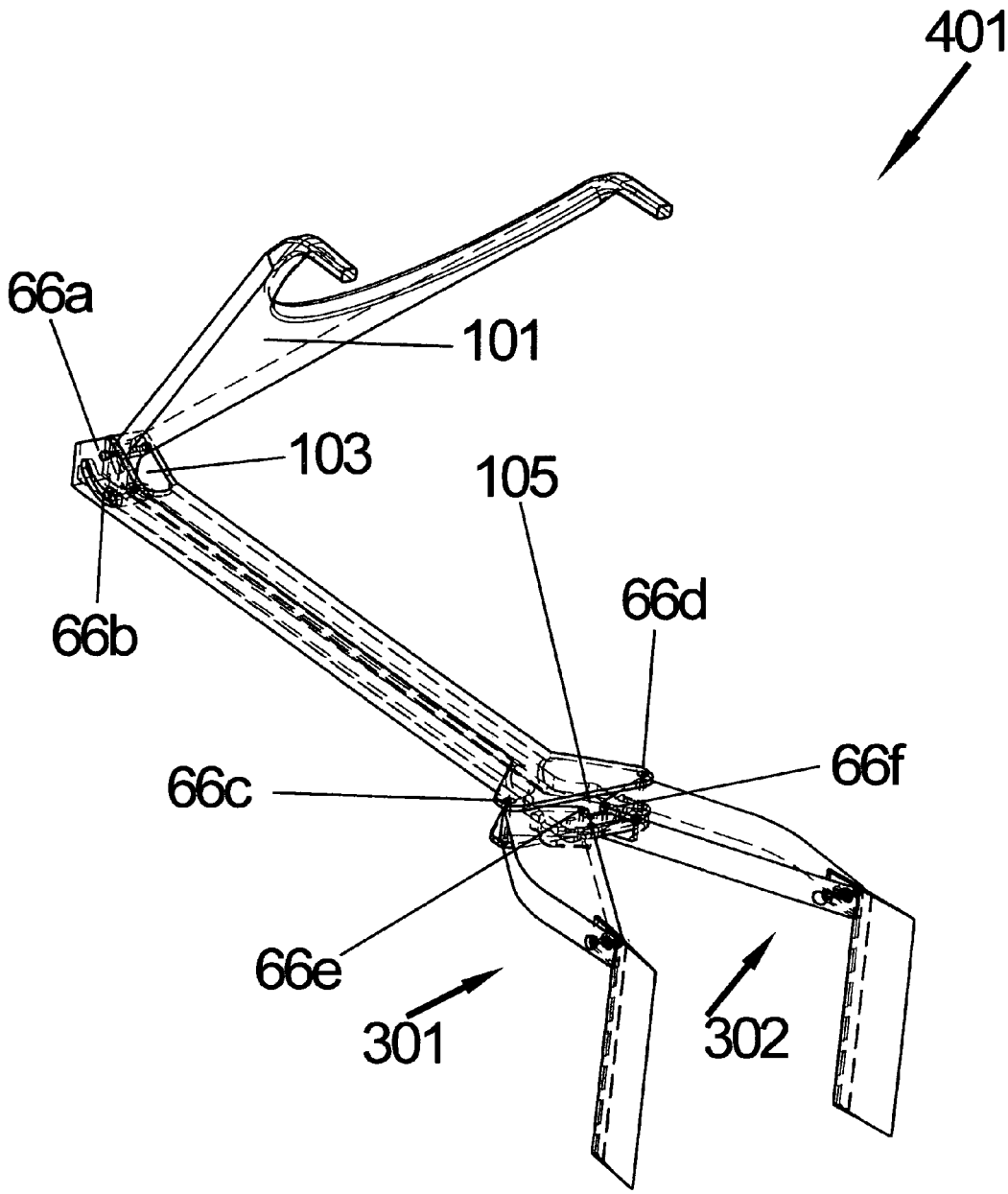

FIG. 14 shows an isometric view of a propulsion device embodiment of the invention.

Figure 15:
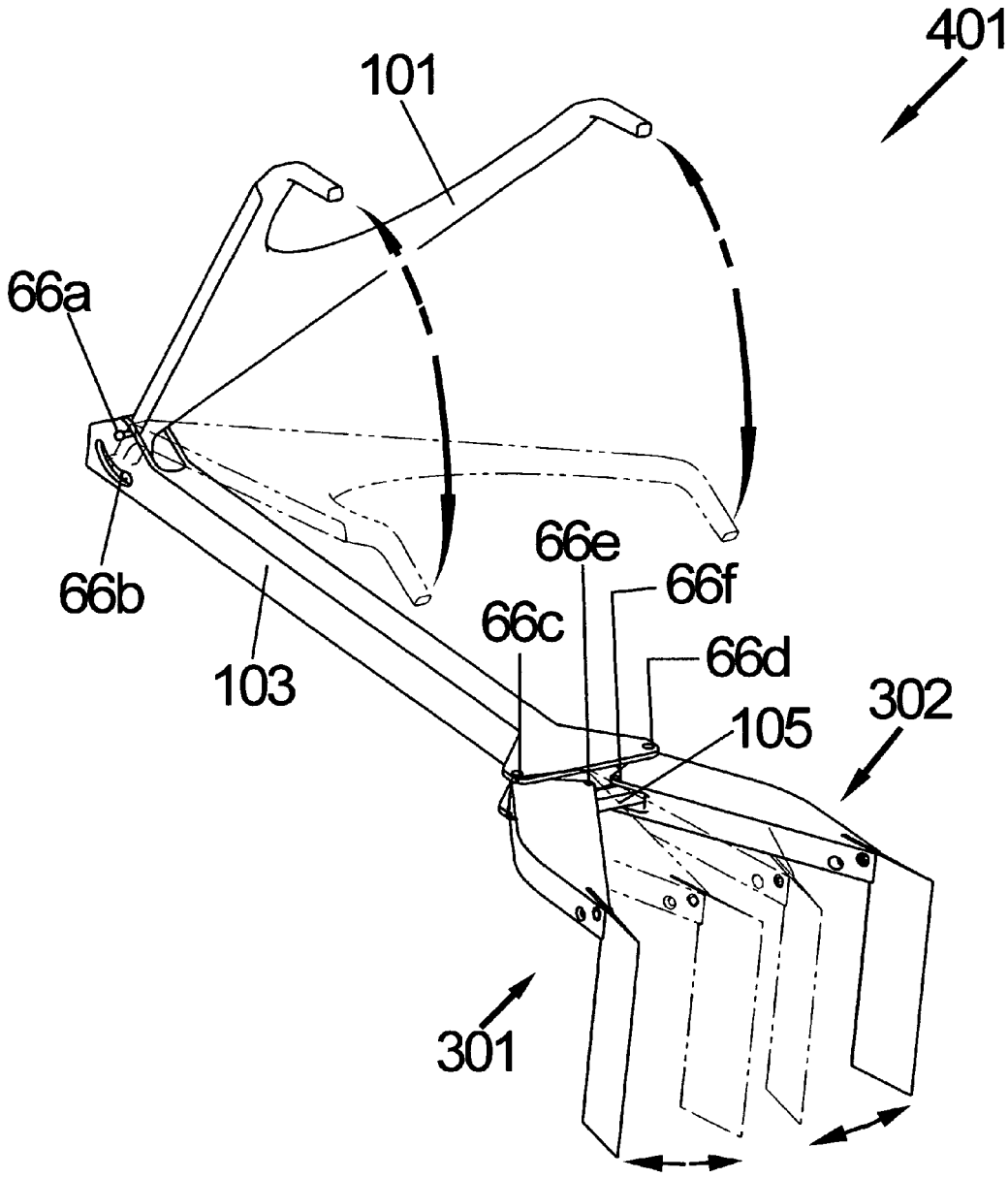

FIG. 15 shows an isometric view of a propulsion device embodiment of the invention with the first rocker and fin-bearing rockers in different actuation positions.

Figure 16:
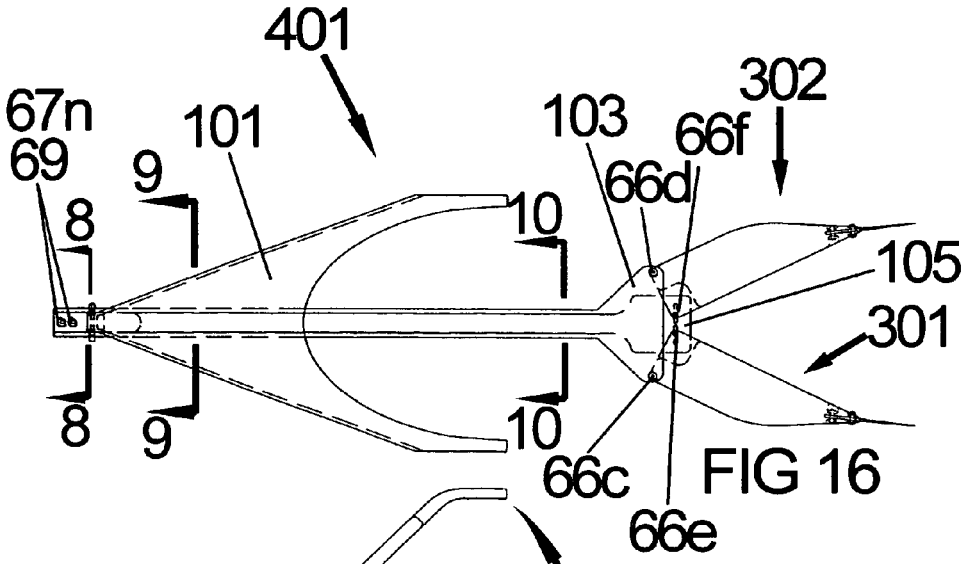
Figure 17:
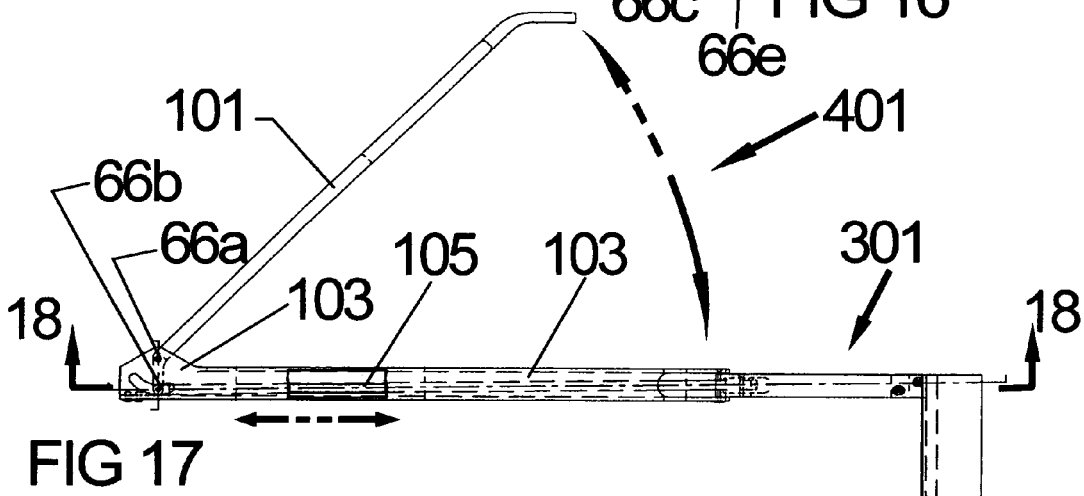
Figure 18:
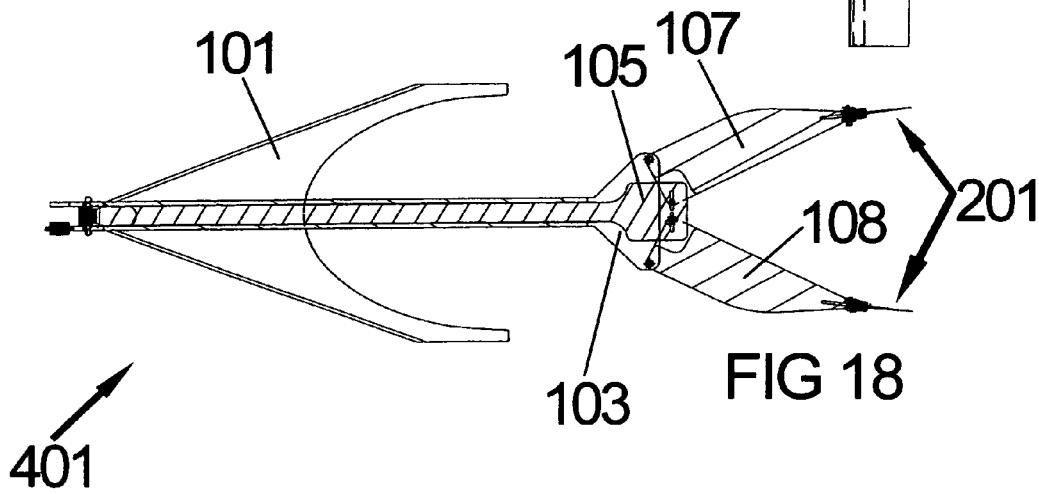

FIGS. 16, 17, and 18 show top, side, and bottom views of the propulsion device of the invention.

FIGS. 19, 20, and 21 show isometric, front, and side views of the first rocker of the invention.

FIGS. 22, 23, 24, 25, 26, 27, and 28 show isometric, side, bottom, longitudinal section, and three lateral section views (FIGS. 26, 27, 28) respectively of the stator-carriage of the propulsion device of the invention.

FIGS. 29, 30, 31, and 32 show isometric, top, section, and magnified detail view of the push-bar of the propulsion device of the invention.

Figure 33:
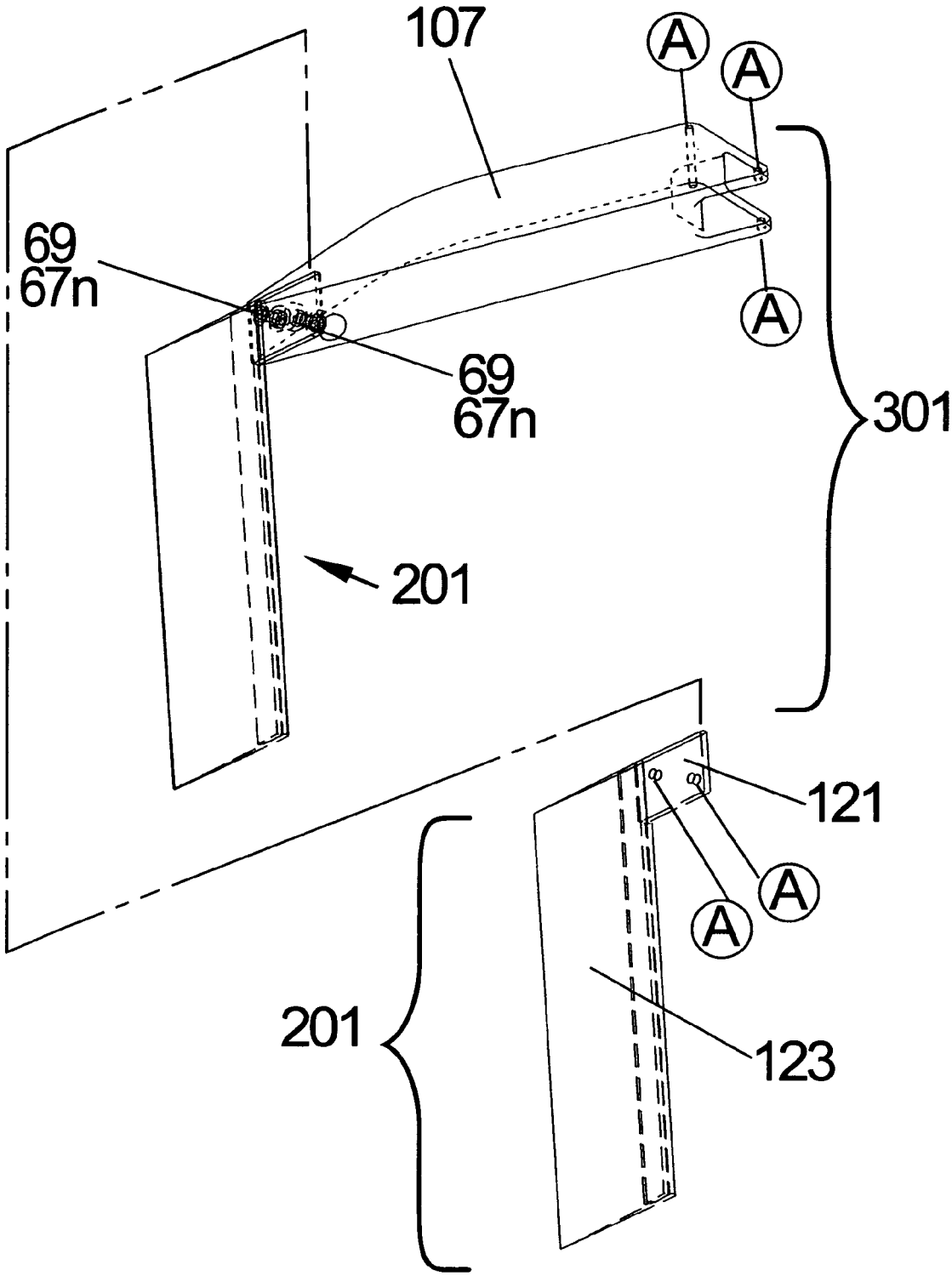

FIG. 33 shows an exploded isometric view of a fin-bearing rocker assembly of the propulsion device of the invention.

Figure 34:
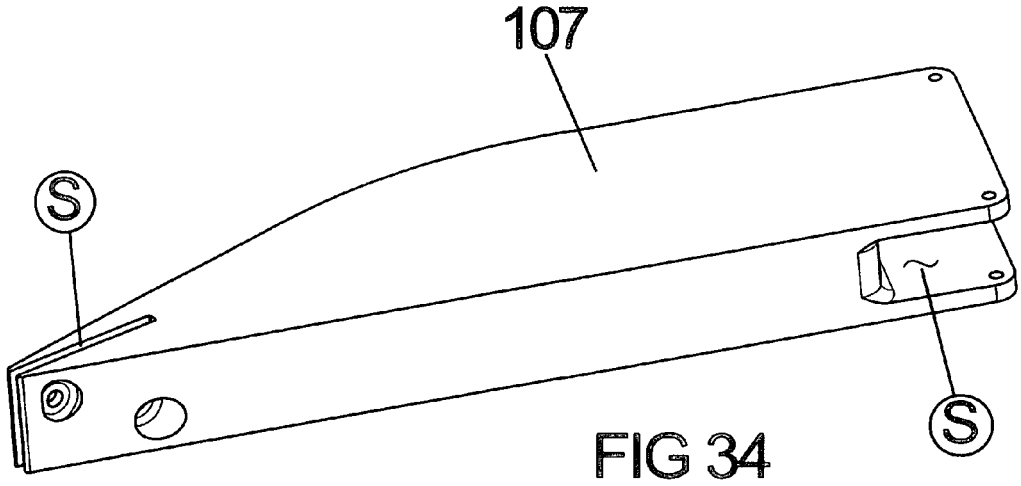
Figure 35:
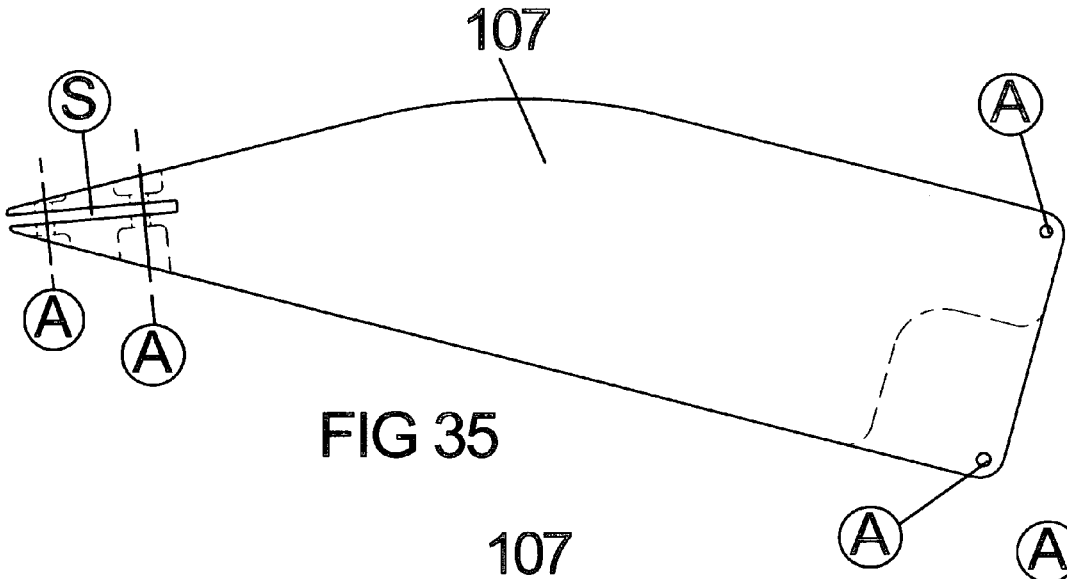
Figure 36:
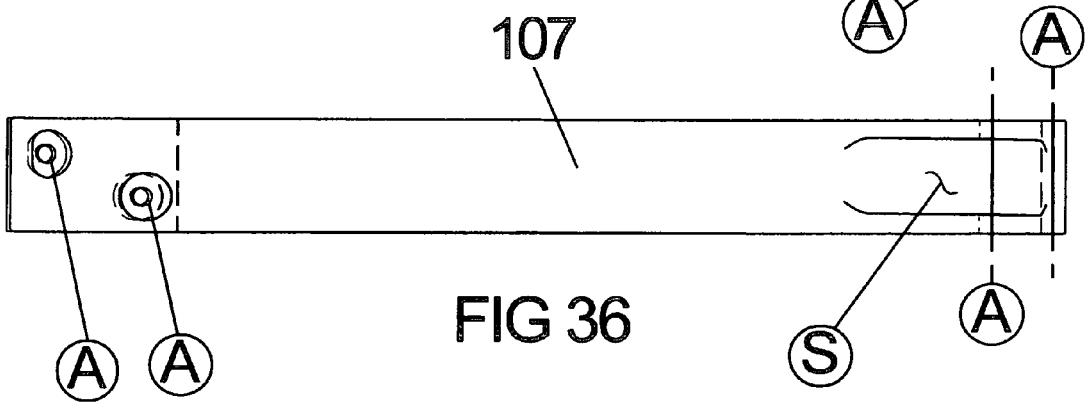

FIGS. 34, 35, and 36 show isometric, top, and front views of a fin-bearing rocker arm.

Figure 37:
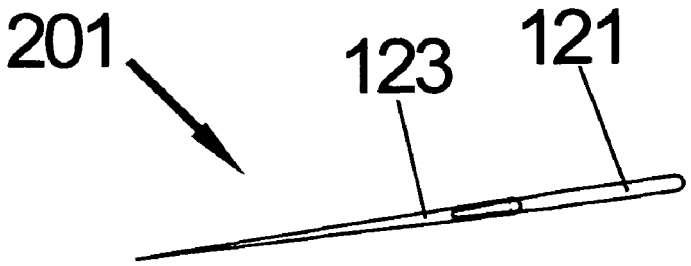
Figure 38:
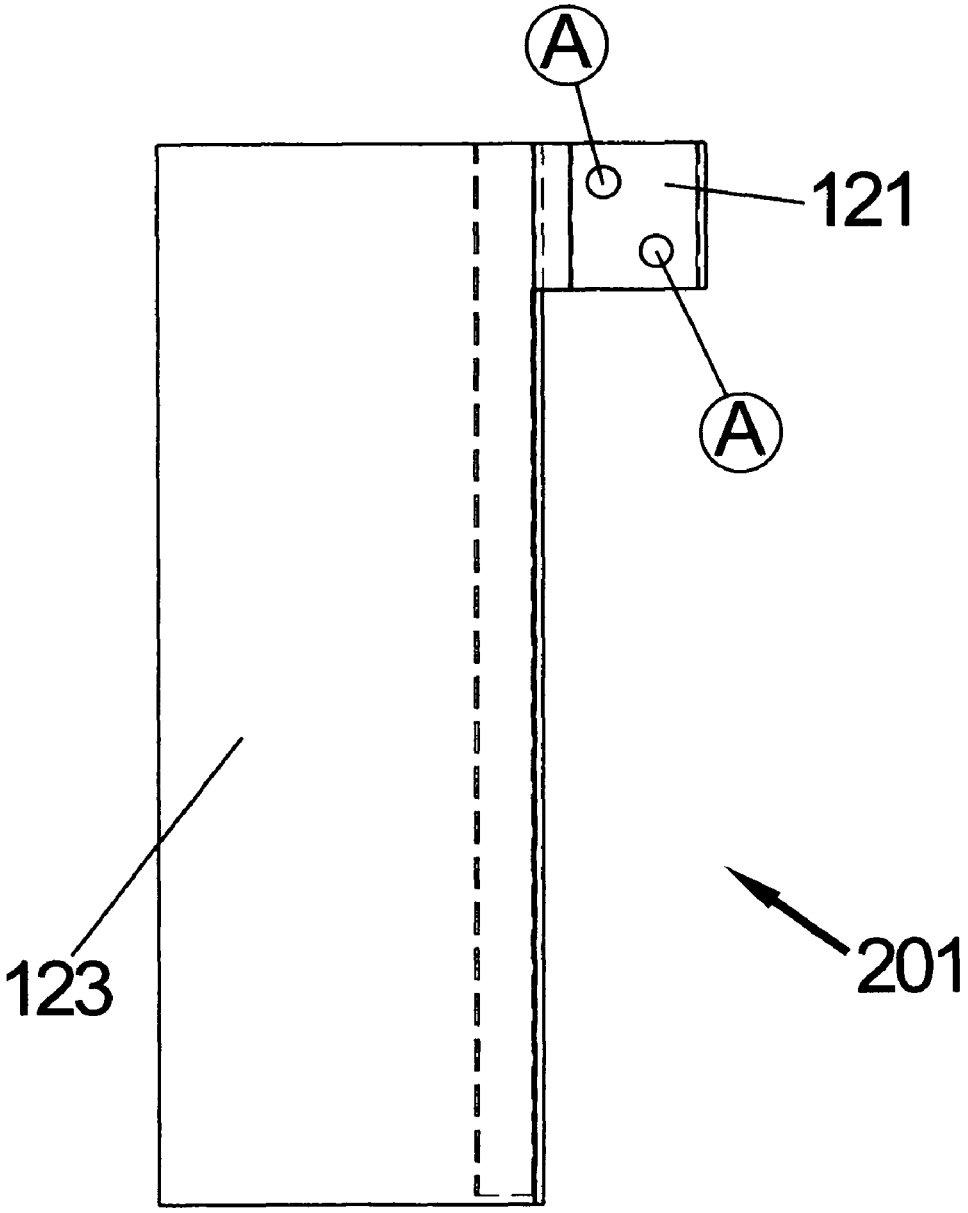

FIGS. 37 and 38 show top and side views of a fin assembly of the propulsion device of the invention.

Figure 39:
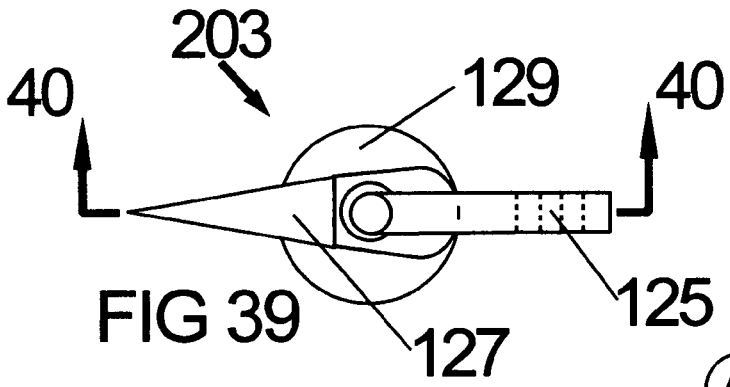
Figure 40:
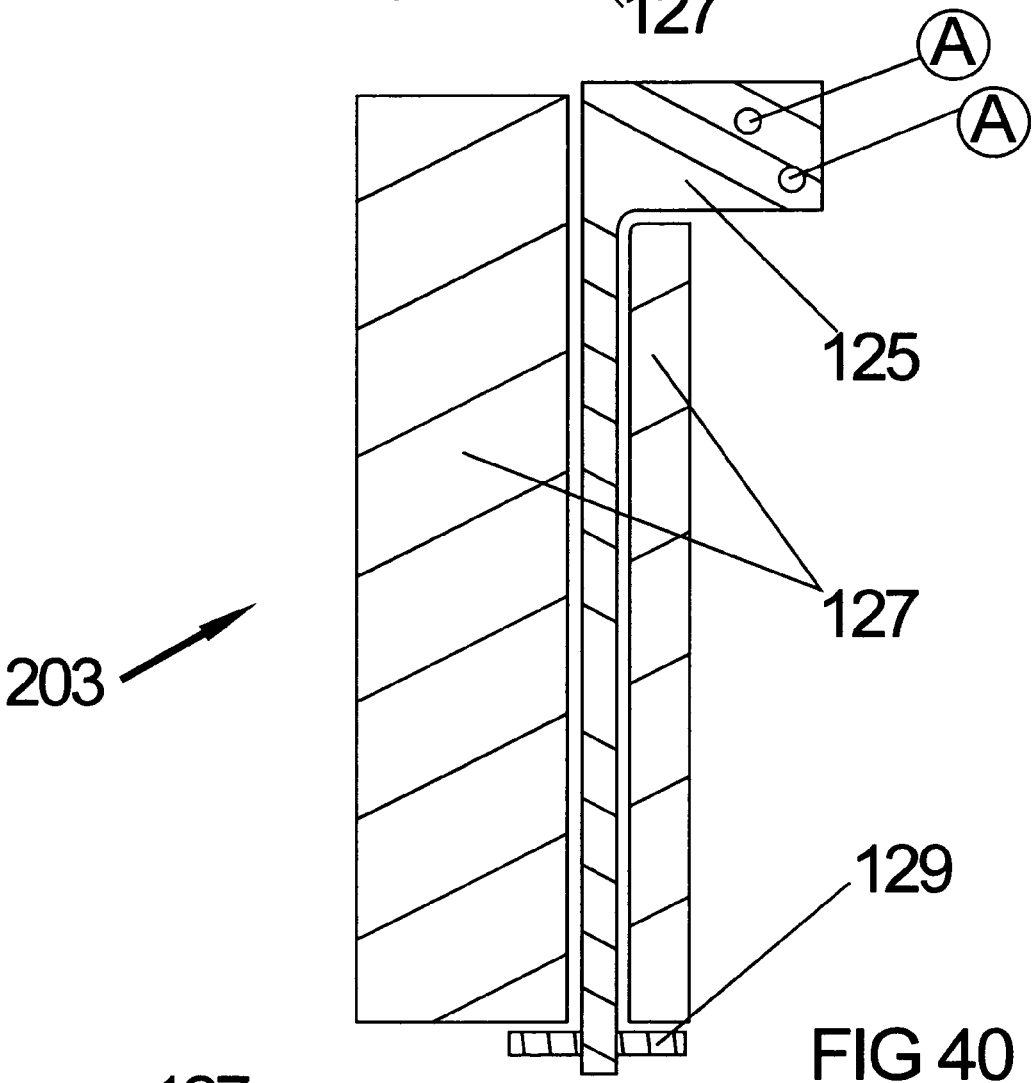
Figure 41:
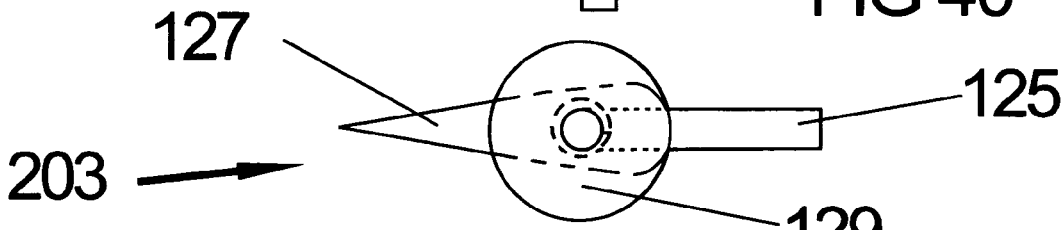

FIGS. 39, 40, and 41 show top view, side view, and bottom view of the pivotal fin of the propulsion device or the invention.

Figure 42:
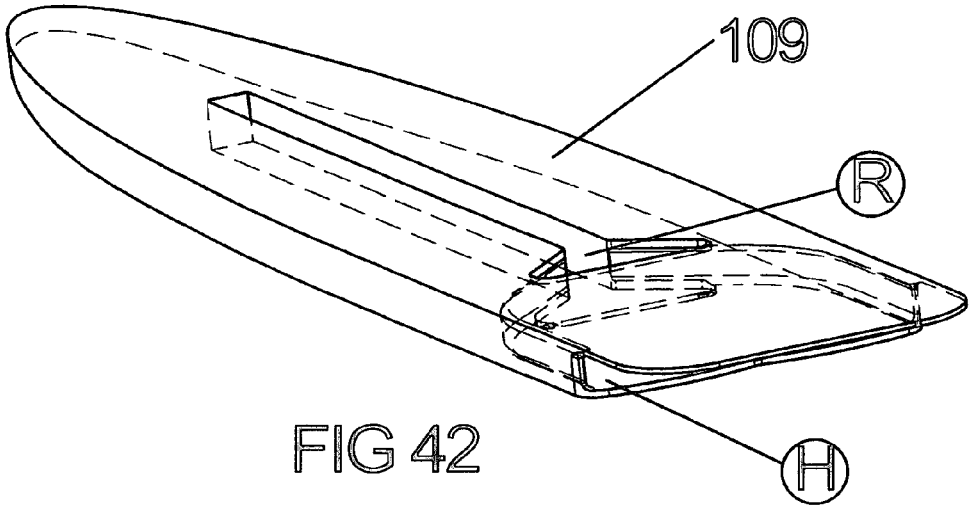
Figure 43:
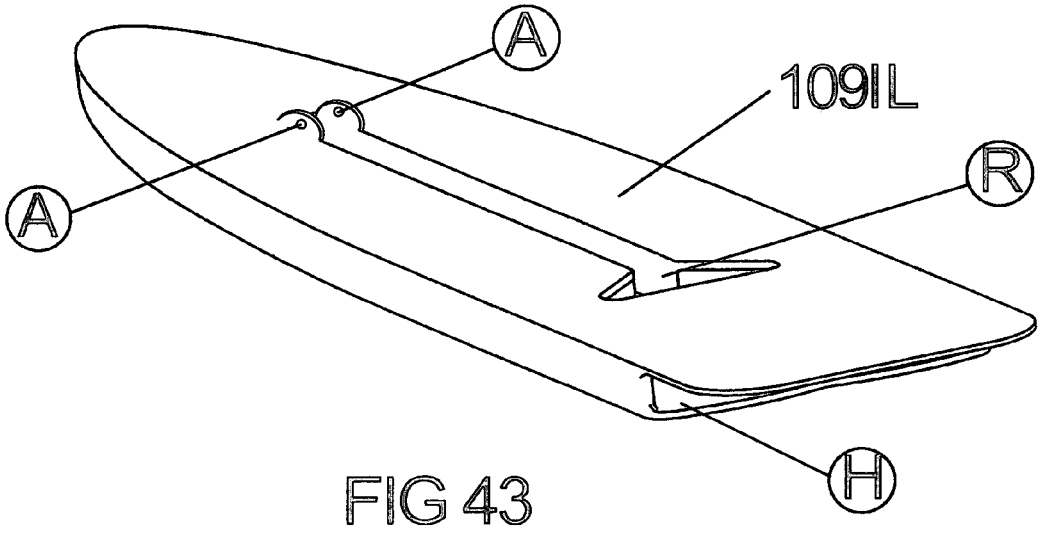

FIGS. 42 and 43 show isometric views of the surfboard of the invention.

Figure 44:
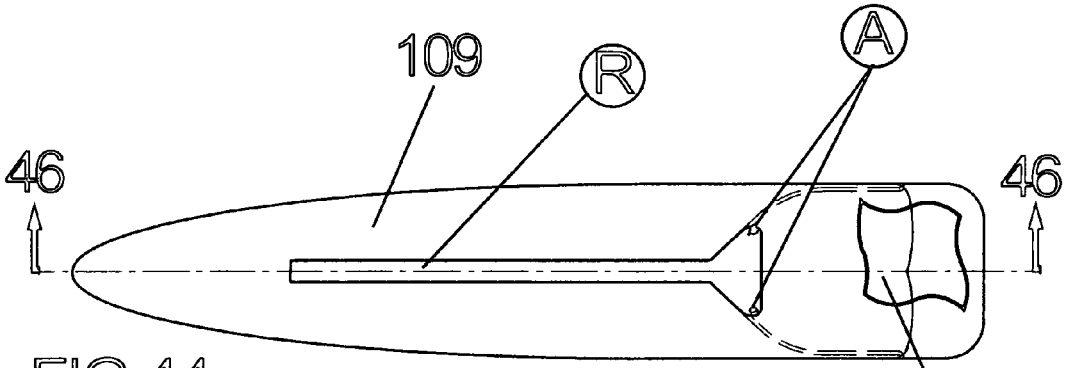
Figure 45:
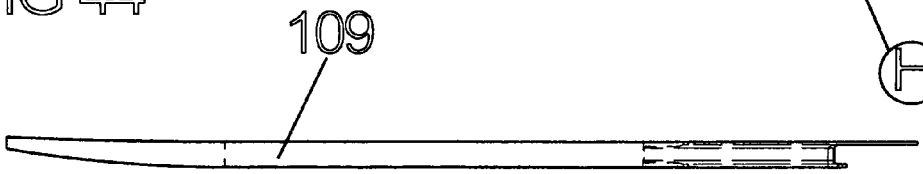
Figure 46:
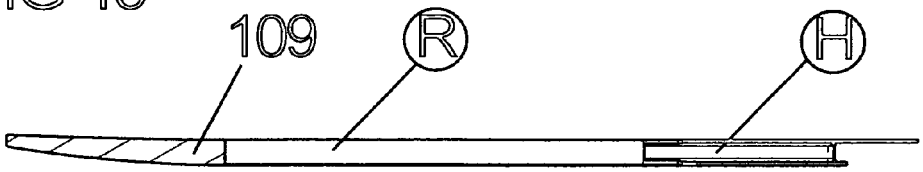

FIGS. 44, 45, and 46, show top, side, and side-section views of the surfboard of the invention.

Figure 47:
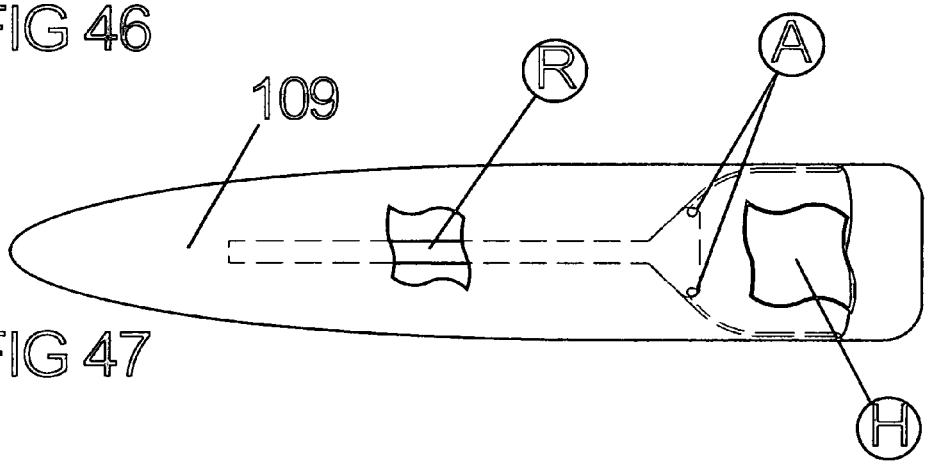

FIG. 47 shows a bottom view of the surfboard of the invention.

Figure 48:
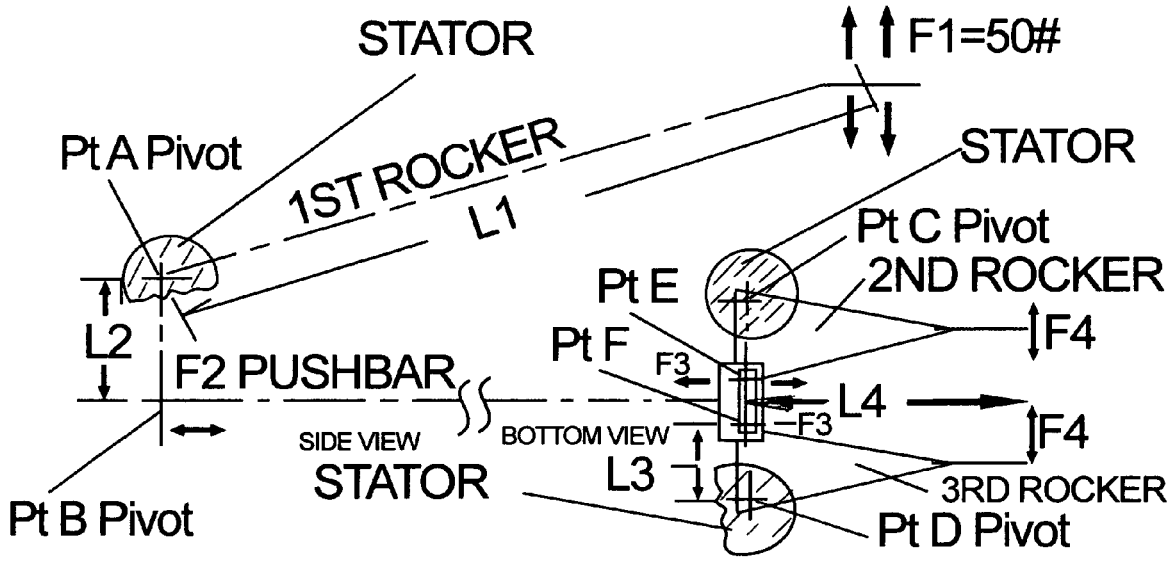

FIG. 48 shows a schematized representation of the pivot-points and skeletal geometry of the propulsion device of the invention.

FIG. 49 shows a table of input-to-output ratios, device component geometries, and simplified force and translation results.

REFERENCE NUMERALS, TERMS, AND SYMBOLS

Left sided parts and assemblies are assigned odd numbers, and mirror-image right sided parts and assemblies of those left-sided parts or assemblies are assigned the next available even number. Except for the six pivot fasteners 66*a* thru 66*f*, parts and assemblies that are self-symmetric are given odd numbers; for example, first-rocker 101 is self-symmetric, as are stator-carriage 103, push-bar 105, and surfboards 109, and 109IL. Unless stated otherwise, a component noted as self-symmetric has symmetry about its long axis and the left side features of the part and the right side features of the part are mirror images to each other. The lowest numbered parts used in this application are 66*a*, 66*b*, 66*c*, 66*d*, 66*e*, and 66*f*, the pivot fasteners of the propulsion device and, the highest numbered component is assembly 501 (human powered watercraft). All part numbers used here follow, and along with a brief explanation are:

501 human powered watercraft; the assembly of surfboard 109 and propulsion device 401.

401 propulsion device assembly comprised of first rocker 101, stator-carriage 103, push-bar 105, fin-bearing rocker assemblies 301 (left) and 302 (right), and pivot-fasteners 66*a*, 66*b*, 66*c*, 66*d*, 66*e*, and 66*f*.

301 fin-bearing rocker assembly (left) comprised of rocker-arm 107 (left), fin assembly 201 (self-symmetric), and attachment fasteners;

302 fin-bearing rocker assembly (right) comprised of rocker arm 108 (mirror image to 107), fin assembly 201, and attachment fasteners.

203 pivotal fin assembly comprised of pivotal-fin 127 (self-symmetric) rotate-ably attached to fin-bar 125, and retainer 129. Pivotal-fin assembly 203 is interchangeable with fin assembly 201 in the fin-bearing rocker assemblies 301 and 302.

201 fin assembly comprised of flexible fin 123 fixedly attached to fin-bar 121. Fin assembly 201 may be co-molded with fin 123 made from a flexible polymer and molded to fin-bar 121 of a rigid composition of matter.

101 first rocker (self-symmetric) having input and output arms, handles, and pivot-apertures. The first rocker 101 makes up one element of the four-bar system of the propulsion device of the invention comprised of first rocker 101, stator-carriage 103, push-bar 105, and fin-bearing rocker assembly 301.

103 stator-carriage (self-symmetric); a hollow stator to the other components of propulsion device 401. It receives and circumscribes the push-bar 105.

105 push-bar (self-symmetric); solid bar having two ends and connecting means near each end to connect to other components of device 401.

107 fin-bearing rocker (left). A solid or shell with pivot apertures and a means to removable receive a fin assembly.

108 fin-bearing rocker (right); the mirror-opposite of fin-bearing rocker 107.

109 surfboard with deck recess and aft hollow, and multiple apertures.

109IL the addition of integral vertical lugs upon the deck of surfboard 109 make 109IL. The lugs have horizontal and transverse thru apertures to receive pivot fastener 66*a* and join first rocker 101 to surfboard 109IL in a preferred embodiment.

121 fin-carrier for flex-fin 123. Fin carrier 121 and flex-fin 123 together make fin assembly 201.

123 flex-fin carried by fin-carrier 121.

125 fin carriage which receives pivotal hydrofoil fin 127 and retainer nut 129 to make pivotal hydrofoil assembly 203.

127 pivotal hydrofoil fin; may be symmetric or non-symmetric.

129 retainer-nut holding pivotal hydrofoil fin 127 onto fin-carriage 125 to make 203 pivotal hydrofoil assembly.

66*a* pivot fastener bolt, joining first rocker 101 and stator carriage 103, or surfboard 109IL. Pivot fastener bolt 66*a* is retained by a standard nut, 67n.

66*b* pivot fastener bolt joining the output arm of first rocker 101 to the first end of push-bar 105. Pivot fastener bolt 66*b* is retained by a standard nut, 67*n*.

66*c* pivot fastener bolt joining second rocker 301 and surfboard 109 and stator-carriage 103; or joining surfboard 109IL and second rocker 301. Pivot fastener bolt 66*c* is retained by a standard nut, 67*n*, or by a standard tee-nut 67*t*.

66*d* pivot fastener bolt joining third rocker 302 and surfboard 109 and stator-carriage 103; or joining surfboard 109IL and third rocker 302. Pivot fastener bolt 66*d* is retained by a standard nut, 67*n*, or by a standard tee-nut 67*t*.

66*e* pivot fastener bolt slid ably engaging push-bar 105 second end slot and the input arm of second rocker 301. Pivot fastener bolt 66*e* is retained by a standard nut, 67*n*.

66*f* pivot fastener bolt slid ably engaging push-bar 105 second end slot and the input arm of third rocker 302. Pivot fastener bolt 66*f* is retained by a standard nut, 67*n*.

Planing-center, denoted as CP in figs: When a watercraft is planing, that point at which the resultant of all the hydrodynamic forces focus, generally vertically upward upon the bottom of a vessel moving at high speed. When planing, there is effectively no buoyancy force.

Center-of-buoyancy, denoted as CB in figs: When static and unmoving, that point at which the resultant of all the hydrostatic forces acting upon a vessel are focused.

Hydrodynamic center, denoted as CH in figs: When under way, a vessel passing thru water is subjected simultaneously to buoyant water forces, and dynamic water forces. The hydrodynamic center here is taken as the resultant point of application of the aggregated water forces acting upon a vessel traveling at less than planing speed.

The following letters when encircled in a figure indicate common and standard features of the subject component of the figure. They are as follows: (A) is an aperture; (H) is a hollow; (S) is a slot; (R) is a recess.

DETAILED DESCRIPTION OF THE PREFERRED EMBODIMENTS

The invention will now be described more fully hereinafter with reference to the accompanying drawings in which some, but not all embodiments of the invention are shown. Indeed, the invention may be embodied in many different forms and should not be construed as limited to the embodiments set forth herein; rather, these embodiments are provided to illuminate, but not restrict the invention. Like numbers refer to like elements throughout.

Figure 1:
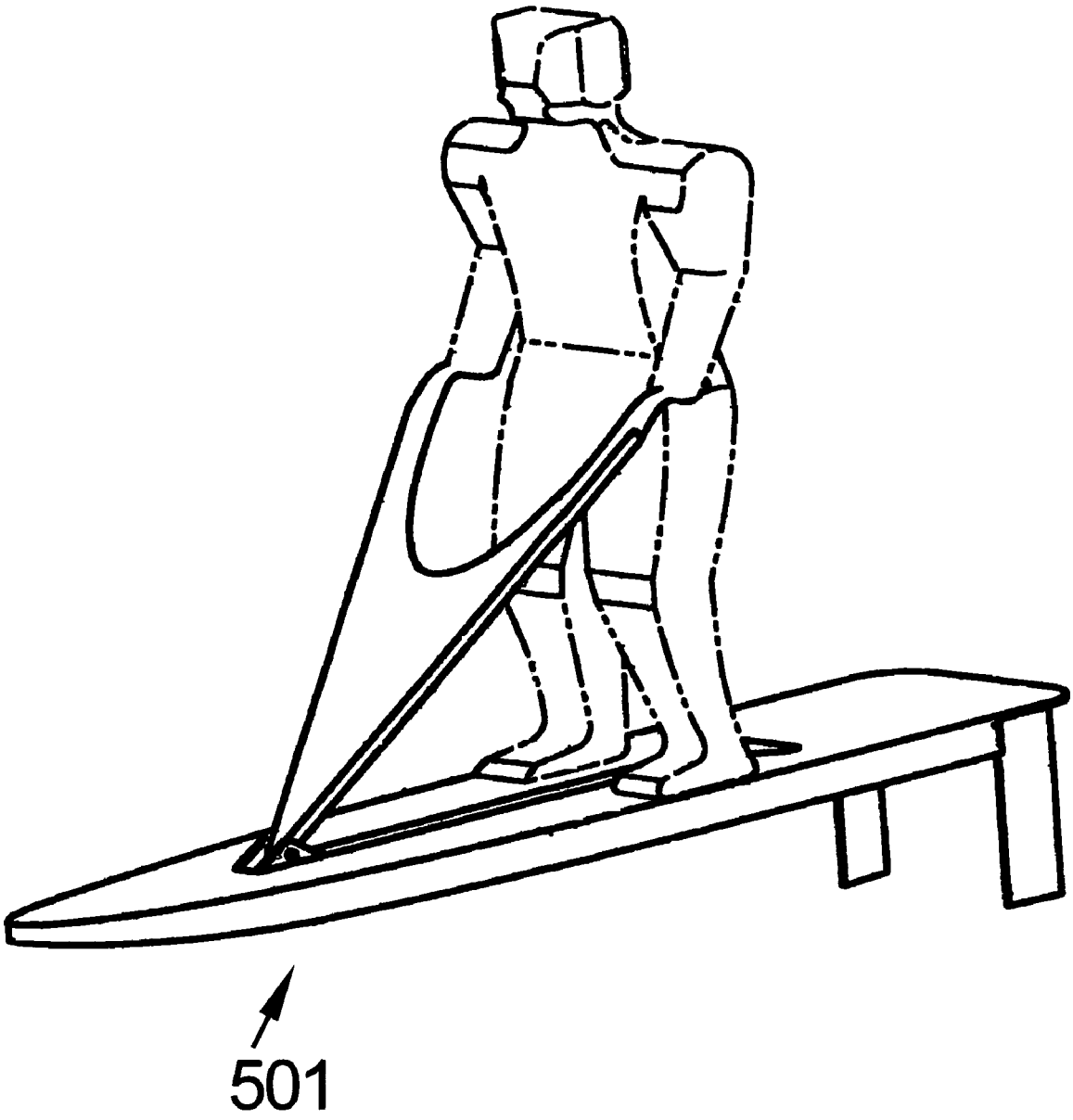
FIG. 1 shows the watercraft of the invention being ridden by a user.

FIG. 1 illustrates watercraft 501 and a rider, the rider being in the standing-upright position with feet upon the deck of the watercraft, in this embodiment, surfboard 109, and hands upon the graspable portions of first rocker 101. It can be seen that while using the system, a rider has very substantial freedom to move about the deck of the surfboard 109 while still grasping the handles of first rocker 101; this allows the rider to align her center-of-gravity with the board center-of-buoyancy, or center-of-hydrodynamic pressure, or the resultant of the two, all the while, actuating the system. And so, since even placid bodies of water are subject to wind, wind-waves, shore-reflected back-chop, and water currents, it is highly advantageous that the rider may both actuate the propulsion system and continuously correct longitudinal trim and lateral trim by body-translation, biased foot-weighting, and hand-torqueing (applied thru the handles of first rocker 101) to optimally adapt to changing conditions and speed onward.

FIG. 1 further shows that the user of the invention may choose to apply propelling forces into the system by any and all of the following: arm forces, leg-major forces, and even ankle flexion also known as plantar-flexing. During force generation by these methods, bodily inertia is reacted vertically by the board by either or both of buoyancy and hydrodynamic lift. Most advantageously, the user is always free of mechanical attachment to the board and yet the force levels attainable for propulsion are majestic in comparison to those of other craft powered by for example pedal-crank systems. While in use, and in the event that a user falls off the craft, it is a much safer egress for the user than for systems where the user is mechanically attached as for example pedal-crank systems using mechanical pedal-clips or straps which fasten or bind the user's feet to a bicycle type watercraft. And since first rocker 101 stows flat to the deck of the surfboard 109, the user is always able maintain the board's floatation capacity close by and easily haul oneself back onto the deck to prone-paddle, knee-paddle, or stand-up and propel. The multiple modes of propulsion offered by the invention of this craft are unique and of singular advantage to users.

Figure 2:
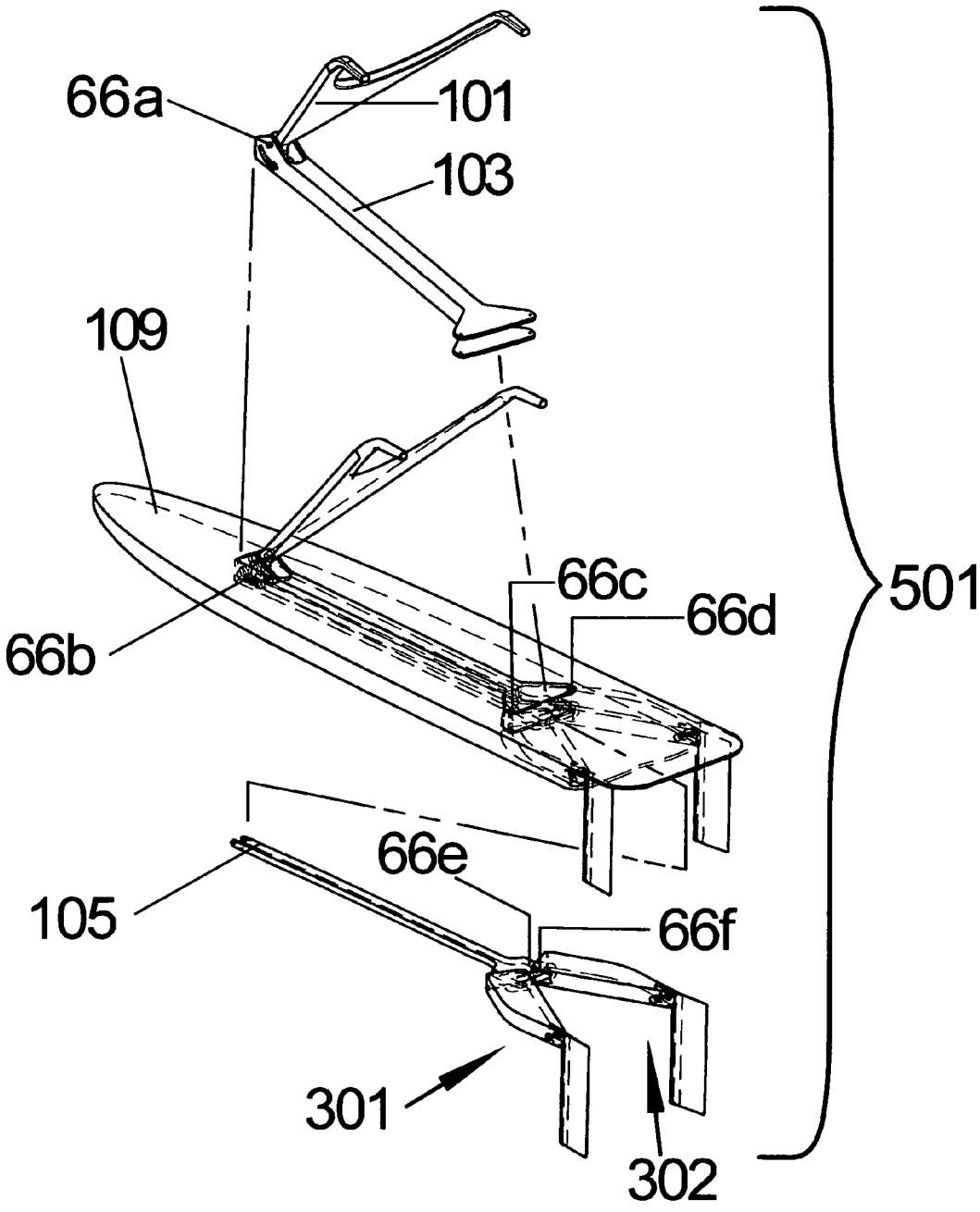
FIG. 2 shows an exploded isometric view of a surfboard embodiment of the watercraft of the invention.

FIG. 2 exploded isometric view shows watercraft assembly 501. Watercraft assembly 501 is made up of surfboard 109 which has both an upper recess and an aft hollow; co-pending U.S. patent application Ser. No. 11/977,224 by this inventor teaches an open hollow surfboard and that is used here. The upper recess and aft hollow of surfboard 109 both receive components for this human powered watercraft. The upper recess receives stator-carriage 103 which is pivoted to first rocker 101 at 66*a* above the output arm of first rocker 101. Together, first rocker 101 and stator carriage 103, and the pivot insert vertically into the recess of surfboard 109 until they bottom out on an upper facing lower surface of surfboard 109. There, the first rocker input-arm and the pivot 66*a* and the upper lugs of the stator carriage 103 project above the surfboard deck. The aft hollow of surfboard 109 receives push-bar 105 and fin-bearing rockers 301 (left) and 302 (right), the fin-bearing rockers 301 and 302 being in rolling and sliding engagement via pivots 66*e* and 66*f* with slots in the actuator head of the push-bar 105. Together, push-bar 105, the pivots 66*e* and 66*f* with nuts 67*n*, and fin-bearing rockers 301 and 302 are inserted forward into the hollow and recess of surfboard 109 with the slender end of push-bar 105 further inserting the longitudinal hollow of stator-carriage 103 until the forward end of push-bar 105 engages the output-arm of the first rocker 101. Then, the loose assembly components at the output-arm of fin-bearing rocker 101 are tilted and lifted up slightly to allow pivot fastener 66*b* to be inserted and join the output-arm of first rocker 101 and stator-carriage 103 thru the radial clearance slots in both sides of stator-carriage 103. Pivot fastener 66*b* is shown as a bolt and nut assembly although other fastener means are equivalent. The components, first rocker 101, stator-carriage 103, and push-bar 105 are then replaced down into the recess of surfboard 109. Fin-bearing rockers 301 and 302 are then pivotally engaged to stator-carriage 103 and surfboard 109 thru common pivot fasteners 66*c* and 66*d*. Here again, the pivot fasteners are nut-and-bolt type and the bolts may be flush to the deck surface of the surfboard 109 and the nuts may be integral to a lower surface of the surfboard 109 as in the case of tee-nuts 67*t*, so minimizing drag and user discomfort. The aft pivot fasteners are then torqued to a predetermined value. The forward end of the stator-carriage 105 is then fastened to surfboard 109 at the forward end of stator-carriage 103. Again flush-type fasteners may be used to reduce fluid-drag upon the vessel. At this point, assembly 501 is fully integrated as a human powered watercraft in a surfboard embodiment. Other watercraft, especially catamarans and pontoon boats are readily adaptable to the system of the invention shown here in FIG. 2 as surfboard 109, first rocker 101, stator-carriage 103, push-bar 105, fin-bearing rockers 301 and 302 and pivots 66*a*, 66*b*, 66*c*, 66*d*, 66*e*, and 66*f*, comprising a surfboard powerable by a standing surfer by applying vertical arm, body, and leg actuations up and down to drive the fins to propel the craft by rotating the fins across the stern and deflecting the fins.

Turning to FIGS. 3, 4, and 5, watercraft 501 is again shown and the correspondence of the input arm of first rocker 101 position with the actuation positions of the fin-assemblies 201 which are carried by the fin-bearing rocker assemblies 301 and 302. In this embodiment, as the handles of first rocker 101 are about horizontal, the fin assemblies 201 are about full breadth of the surfboard 109 apart. As the first rocker is actuated to lower positions, the fin assemblies are urged to close until the first rocker 101 is about horizontal and the fin assemblies are about closed to the longitudinal centerline. These figures illustrate the essence of the propulsive mode of operation of the system; that the first rocker 101 may be actuated down and up and the fin assemblies follow by closing and opening. It is from this motion that propulsive forces are imparted to the water to propel the rider and craft. The stern deck of surfboard 109 projects aft over the propelling-fin assemblies 201 and this feature, suggested in applicant's '224 application both guards the user against injury by the fins while at the same time increasing the propulsive efficiency of the fins by directing down and aft-ward any wave-lip generated by the fins.

Turning now to FIGS. 6 and 7, these illustrate side and bottom views of watercraft 501 and components: first rocker 101, stator-carriage 103, pivot 66*a*, pivot 66*b*, push-bar 105, pivots (rollers) 66*e*and 66*f*, pivots 66*c* and 66*d*, fin-bearing rockers 301 and 302, and surfboard 109. The side view, FIG. 6 also shows a rider in position standing upright upon the deck. The rider is grasping the handles of first rocker 101 and, it is thru the handles that all human applied forces are transferred into the system to propel it thru the water. By keeping the rider free of mechanical linkage to the craft, the rider of the invention is substantially free to move about the deck, forward and aft, even to lean well forward while holding the handles and to actuate the system while at the same time maintaining fine longitudinal trim with respect to the water reaction forces buoyancy and hydrodynamic displacement, trans-planing and hydro-planing. The rider may also lean left and right to affect carving-turns. Small vessels are acutely sensitive to trim and well powered but badly trimmed vessels are often slow while vessels of fine trim, fine lines, and modest power are yet able to reach exhilarating speeds. With regard to the invention, the freedom to move about the deck and propel solves the quandary of how to deal with the vagaries of predicting the position of the forces of static buoyancy force, low-speed displacement forces, trans-planing dynamic forces, and planing dynamic forces; the rider simply adjusts her position to over the apparent resultant force; the resultant force being apparent by the crafts attitudinal position and how it looks and feels like it is going; it is both intuitive and a learned art. Generally, as the craft goes faster, and unto planing mode, the rider will inch his way aft so his center-of-gravity (denoted as CG in figs) is coincident and opposing the vessel center-of-planing vertical force. For a surfboard, the planing center moves aft of the buoyant center with increasing planing speeds.

In FIG. 7, the bottom view shows the invented craft overall. Surfboards are relatively narrow, typically less than 30 inches, and frequently about 24 inches wide and of varying length. The invention is typical to those dimensions although the beam may be wider than 30 inches, here it is about 24 inches, and the length is about 10 feet although any length is suitable to the invention from as little as 3-4 feet length to as long as 16-18 feet, and longer. The point here is that a surfboard of about normal breadth, here 24 inches has room in the hollow for the fin-bearing rockers 301 and 302 to oscillate back and forth over a total range of about a foot each, a total of about a two-foot stroke. This is in coordinated and predetermined response to the rider making actuating input to the first rocker 101 of a predetermined vertical stroke, for example, a user down-stroke of say 12 inches can, by design yield a total (301 and 302) fin stroke of 24 inches for an input-to-output ratio of 1:2; infinitely other ratios are designable: 1:½,1:1, 1:2, 1:3, 1:4, and so-on without limit. These design approaches are taught later in the text of this application. Returning attention to FIG. 7, the handles of first rocker 101 in this embodiment are just overhanging the sides of the surfboard 109; this allows the first rocker 101 to stow flat and horizontal upon the deck of the surfboard 109 which in-turn allows the rider to paddle the surfboard by hand from a supine position and also, from the knees, both classical surfboard propulsion methods. For this embodiment, having the first rocker stowed upon the desk, in turn stows the fins together at the vehicle longitudinal centerline; the craft then simulates a single-fin surfboard. With the first rocker 101 up and deployed at about 45 degrees from the horizontal, and the handles of first rocker substantially horizontal, the fins are positioned close to as far horizontally out as a twin-fin surfboard, and the performance of the vessel is liken-able to a twin-fin surfboard with directionally authoritative fins; with added upstroke by the user of the first rocker, the fins can be made to bear-out upon the lateral insides of the hollow of the surfboard, and stop. FIG. 7 further shows the push-bar 105 of the system has at its aft end a head portion, in this case squarish, though it may be of many and varied shapes. In the head portion of push-bar 105 are vertical thru-slots which in this case are transverse the craft longitudinal centerline. These slots engage and urge pivots (rollers) 66*e*, and 66*f* common to fin-bearing rockers 301 and 302 to rotate the fins about the beam of the vessel as push-bar 105 is itself urged forward and aft by the output-arm of first rocker 101 thru their common pivot 66*b*, all in cooperative entrainment to the user input up and down of the handles of the first rocker 101.

Figure 8:
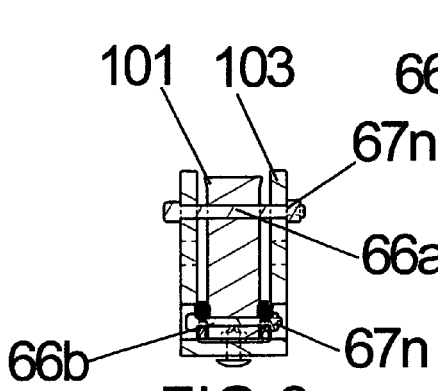

FIG. 8 section view taken at mid-pivot of 66*a* and 66*b* of the output arm of first rocker 101 and shows first rocker 101 output arm, stator-carriage 103 along with pivot pin-fasteners 66*a* and 66*b*. Pivots 66*a* and 66*b* are here standard bolt and nut fastenings, although, lynch pins and other quick release shafts are equally suitable. Pivot 66*b* can be inserted the joint thru the clearance slot on both sides of and thru stator-carriage 103 after pivot 66*a* is first joined to first rocker 101 and stator carriage 103.

Figure 9:
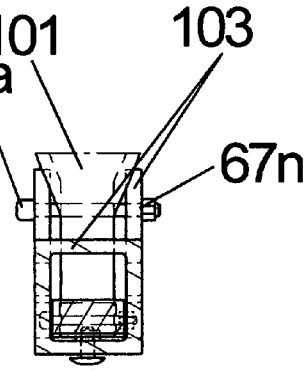

FIG. 9 section view shows first rocker 101 and stator-carriage 103 and push-bar 105, pivots 66*a* and 66*b*.

Figure 10:
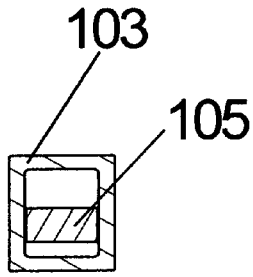

FIG. 10 section cut shows stator carriage 103 and push-bar 105. The section geometries shown are exemplary and other geometries might be circular, elliptical, or other, and portions along push-bar 105 may be either hollow or solid. The simplest sections to manufacture are usually squares and rounds and so, these are presently preferred. It can be seen that stator-carriage 103 potentially bolsters push-bar 105 against column instability during cases of high-induced loading as for example when a rider has to escape the path of an approaching power-boater, or for another example if the user while beaching the craft fully weights the first rocker with his body-weight. Push-bar 105 may be designed and fabricated of a size to just clear the inner surfaces of stator-bar 103 and so maximize the column-structural integrity of push-bar 105 while at the same time enabling weight reductions by hollowing push-bar 105 internally. It is a matter simple to one of average skill in the art to design and produce components that are robust and with good factors of safety against failure for normal operating loads, on the order of about fifty pounds maximum of thrust at the stem, and for accidental loadings.

Figure 11:
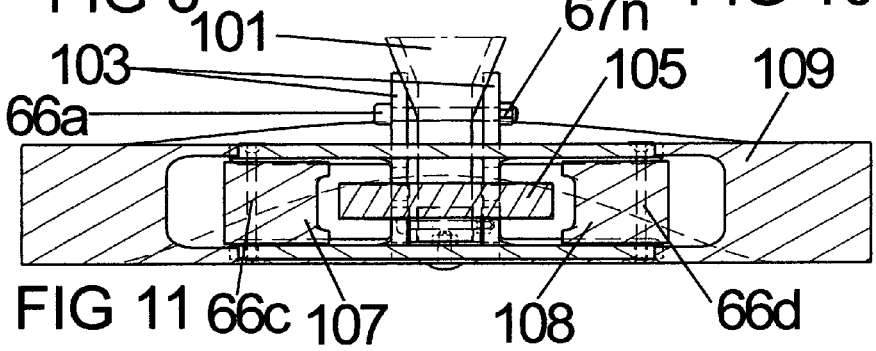

FIG. 11 section view shows first rocker 101, stator-carriage 103, push-bar 105, fin-bearing rocker 107, fin-bearing rocker 108, surfboard 109, pivots 66*a*, 66*b*, 66*d*, 66*f*, and fastener joining stator carriage 103 and surfboard 109.

Figure 12:
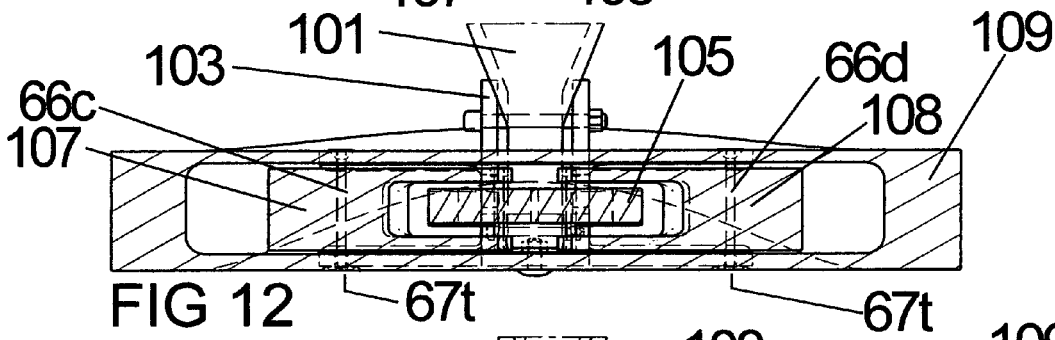

FIG. 12 section view shows first rocker 101, stator-carriage 103, push-bar 105, fin-bearing rocker 107, fin-bearing rocker 108, surfboard 109, pivots 66*a*, 66*b*, 66*d*, 66*f*, and fastener joining stator carriage 103 and surfboard 109.

Figure 13:
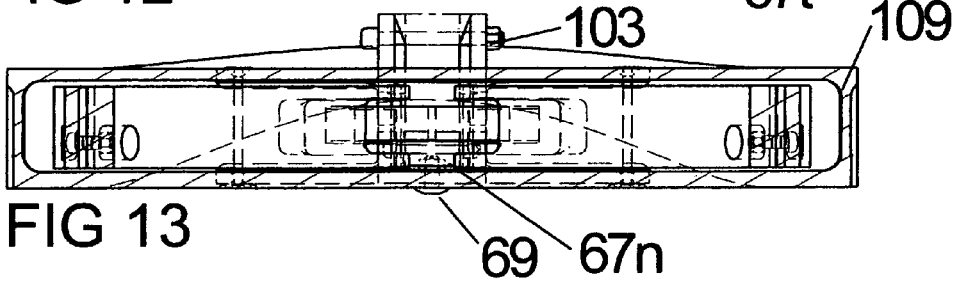

FIG. 13 section view shows first rocker 101, stator-carriage 103, push-bar 105, fin-bearing rocker 107, fin-bearing rocker 108, surfboard 109, pivots 66*a*, 66*b*, 66*d*, 66*f*, and fastener joining stator carriage 103 and surfboard 109.

FIG. 14 isometric view shows preferred embodiment propulsion assembly 401 comprised of first rocker 101, pivoted at Pa to stator-carriage 103 and at 66*b* to push-bar 105, fin-bearing rocker assembly 301 pivoted at 66*c* to stator-carriage 103, fin-bearing rocker assembly 302 pivoted at 66*d* to stator-carriage 103. Push-bar 105 has slot-means slide-ably engaging pivot 66*e* of fin-bearing rocker assembly 301 and pivot 66*f* of fin-bearing rocker 302. The fin-bearing rockers 301 and 302 used in this case remove-ably receive fin-assemblies 201 which are comprised of flexural fins 123 which are molded to fin-carrier 121; the fin-carrier 121 is ideally made from noble metals such as CRES (corrosion-resistant-steel), titanium, or fiber-reinforced polymers. Since the fin assemblies are remove ably attached, users can try fins of differing stiffness and even replace the fin assemblies with pivotal hydrofoils covered later in this text. Propulsion assembly 401 is readily installed in many different boats; for example catamarans, pontoon boats, outrigger canoes, inflatable rafts and boats.

FIG. 15 isometric view shows propulsion assembly 401 comprised of first rocker 101, pivoted at 66*a* to stator-carriage 103 and at 66*b* to push-bar 105, fin-bearing rocker assembly 301 pivoted at 66*c* to stator-carriage 103, fin-bearing rocker assembly 302 pivoted at 66*d* to stator-carriage 103. Push-bar 105 has slot-means slide-ably engaging pivot 66*e* of fin-bearing rocker assembly 301 and 66*f* of fin-bearing rocker 302 first rocker 101 is shown in an upright position and a lower actuated position and the fin-bearing rocker assemblies 301 and 302 are shown in an open position and an actuated nearly closed position. The actuation of the first rocker 101 rotationally about pivot 66*a* drives push-bar 105 forward or aft in turn driving fin-bearing rockers 301 and 302 about pivots 66*c* and 66*d* open or closed, causing the fins of the fin-bearing rocker assemblies to deflect in closing or opening and propel the craft. The position of the various pivots controls the input-to-output ratio of the propulsion assembly and the length, width, and height of the components. There is no limit to the number of input-to-output ratios attainable by discreet design of the various components as driven by the pivot position geometries. For broad beamed boat applications, the system can be designed to allow the fin-bearing rockers to travel broadly across the beam of the boat to any value suitable to the boat beam dimension and the intended use. For narrow-beamed boat and surfboard application, likewise the system can be designed so that it efficiently captures a user input and translates that input effectively into propulsive power within the narrower breadth of a kayak or surfboard.

FIG. 16 shows a top view of assembly 401, first rocker 101, push-bar 105 which at the end portion of push-bar 105 has a plate portion with transverse slots which operatively engage 66*e* and 66*f* pivots common to fin-bearing rocker assemblies 301 and 302. Fin-bearing rockers 301 and 302 engage pivots 66*c* and 66*d* common to stator-channel 103. At the forward end of assembly 401 common to stator-channel 103 are two attachment fasteners for attaching assembly 401 at the forward portion to a watercraft; also, 66*c* and 66*d* pivots common to stator-carriage 103 and fin-bearing rockers 301 and 302 may engage a watercraft and secure the 401 assembly to the watercraft.

Turning now to FIGS. 16, 17, and 18: The components of propulsion assembly 401 are cooperatively entrained to pivots 66*a*, 66*b*, 66*c*, 66*d*, 66*e*, and 66*f*. As first rocker 101 input-arm is pushed down or up by a user, it pivots around 66*a* common to stator-carriage 103. In practice, stator-carriage 103 is remove-ably attached to a watercraft by many different fastening means. As the input-arm of the first rocker 101 pivots about 66*a*, the output-arm of first rocker 101 likewise pivots about 66*a* and thereby converts the above-deck human exertion into below-deck motion; here, the output-arm of first rocker 101 is pivoted to push-bar 105 at a forward end of push-bar 105. Push-bar 105 translates forward and aft and within the interior hollow of stator carriage 103, and the aft end of push-bar 103 has slot-means for engaging pivots 66*e* and 66*f* which are themselves common to fin-bearing rocker assemblies 301 and 302 respectively. So, as push-bar 105 translates forward and aft, the slot-means in its aft end urges the pivots 66*e* and 66*f* common to fin-bearing rocker assemblies 301 and 302 respectively to rotate the fin rockers about pivot 66*c* common to fin-bearing rocker 301 and a watercraft and, and 66*d* common to fin-bearing rocker 302 and a watercraft. The depicted propulsion assembly 401 is compact, lightweight and well-captures the maximum strength potential unique to the human form in our ability to stand upright with great forcefulness and assembly 401 transfers these forces thru the hands into the system and ultimately into the water. Those of normal skill in the art will readily apprehend that infinite pivot-position geometries are possible within the scope and spirit of the invention. For example, pivot 66*a* may be as far as 24-36 inches above 66*b* or may be as close as an inch or less; pivots 66*e* and 66*f* shown inboard of pivots 66*c* and 66*d* may likewise be as close as less than an inch from respective 66*c* and 66*d* or may be relatively afar; furthermore, 66*e* and 66*f* may be not just inboard, but may be outboard of, forward of or aft of respective pivots 66*c* and 66*d*. Pivots 66*c* and 66*d* are of course variously position able by the designer. Axiomatically, the pivot positions in turn define the necessary part geometries of length, width, height, and thickness for the pivot-receiving structural components of the propulsion device 401. Some designers may prefer to reduce stresses and to use natural woods and so will benefit by using pivot position geometries which result in input-to-output translational equivalence, or nearly so. Designers focusing on sprint speed may want high input-to-output ratios from the system and to use the lightest weight materials, for example graphite-fiber reinforced resins. Other designers may prefer to optimize the propulsion device for long-distance racing or recreational cruising. All are possible within the overall invention system of my human powered propulsion device.

FIG. 17 shows a side view of assembly 401, first rocker 101, push-bar 105 which at the end portion of push-bar 105 has a plate portion with vertically thru transverse slots which operatively engage 66*e* and 66*f* pivots common to fin-bearing rocker assemblies 301 and 302. Fin-bearing rockers 301 and 302 engage pivots 66*c* and 66*d* common to stator-channel 103. At the forward end of assembly 401 common to stator-channel 103 are two attachment fasteners, bolts 69 and nuts 67*n* for attaching assembly 401 at the forward portion to a watercraft. At the aft end of stator-channel 103, pivots 66*c* and 66*d* common to stator-carriage 103 and fin-bearing rockers 301 and 302 may engage a watercraft and secure the 401 assembly to the watercraft with the use of common nuts, 67*n* or 67*t* or other;

FIG. 18 shows a bottom section view of assembly 401, first rocker 101, push-bar 105 which at the end portion of push-bar 105 has a plate portion with vertically thru transverse slots which operatively engage 66*e* and 66*f* pivots common to fin-bearing rocker assemblies 301 and 302. Fin-bearing rockers 301 and 302 engage pivots 66*c* and 66*d* common to stator-channel 103. At the forward end of assembly 401 common to stator-channel 103 are two attachment fasteners for attaching assembly 401 at the forward portion to a watercraft; also, 66*c* and 66*d* pivots common to stator-carriage 103 and fin-bearing rockers 301 and 302 may engage a watercraft and secure the 401 assembly to the watercraft.

Looking now at the detail of first rocker 101, FIGS. 19, 20, and 21 illustrate first rocker 101 in isometric, front, and side views. First rocker 101 has a graspable input arm, and an output arm, a transverse aperture at the juncture of the input and output arm, connecting opposing sides of the juncture. The output arm also has a transverse aperture connecting opposing sides of the output arm. In FIG.20, the front view, first rocker 101 is shown having an internal core construction. First rocker 101 may be fabricated by standard methods of construction from solid or laminated wood, solid laminated fiber-reinforced plastics (FRP), balsa-core and FRP, hexagonal ribbon-core and FRP; the output arm is ideally of solid construction; the graspable portion projections may be of any ergonomic shape for example round, elliptic, square, square with rounded corners and are most preferably hollow. Front view FIG. 20 shows that first rocker 101 has a clearance opening, in this case an ellipse which allows the user to move forward with substantial liberty to adjust the users center of gravity over the watercraft's center-of-buoyancy and hydrodynamic center. The elliptic clearance allows the user to wear a floatation vest during use. The clearance can be larger of smaller and of various geometric configurations. First rocker 101 may advantageously be filled with floatation material in a hollow configuration of first rocker 101.

Details of the stator-carriage 103 are shown in FIGS. 22, thru 28.

FIG. 22 shows isometric view of stator-carriage 103. Stator-carriage 103 is hollow thru its length and has vertical projections at the forward end and horizontal tabs projecting laterally at the aft end. The projections have thru-apertures for engaging pivots of the propulsion device. Below the forward end pivot-apertures in the vertical faces of the stator-carriage 103 there are radial cut-outs centered on the apertures and extending from a lower 6 o-clock position to about a 9 o-clock position. These go thru the carriage and are clearance cuts to allow the first rocker 101 to be pivotally fastened to the push-bar 105. The cut-outs allow the pivot fastener to be inserted and torqued to a desired amount. Depicted as square, stator-carriage 103 can be of many geometric shapes, circular, elliptical, rectangular and so on. The stator-carriage can be made from metals, titanium, CRES, or composites of resin and fiberglass, aramids, or graphite.

FIGS. 23, 24, and 25, show left, bottom, and right sections of stator-carriage 103.

FIGS. 26, 27, and 28 show section views of stator-carriage 103.

FIGS. 29 thru 32 show details of push-bar 105.

Figure 29:
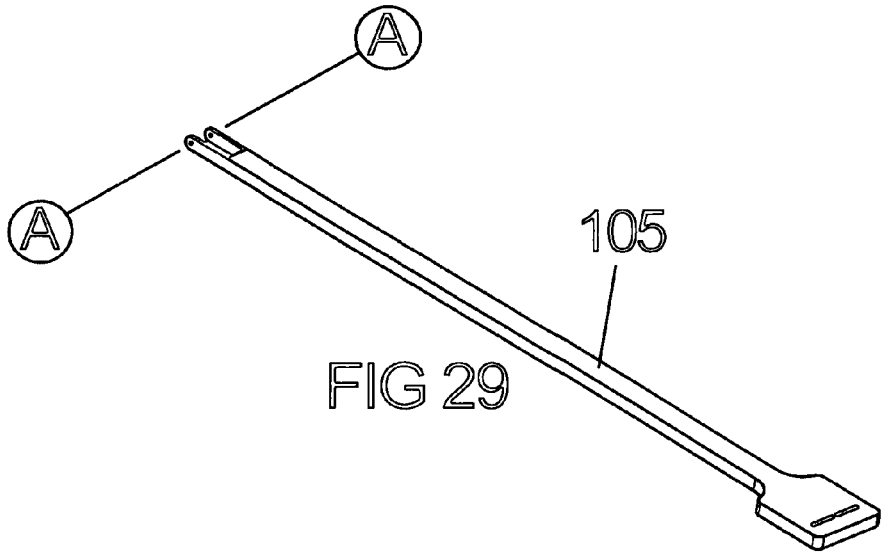

FIG. 29 shows push-bar 105 in isometric perspective view. It has a first end with a vertical slot and a transverse aperture completely thru the sides of the first end of push-bar 105. Push-bar 105 has a second end having vertical slots which go from inboard to outboard and connect the top and bottom surfaces of push-bar 105. The aperture in the first end of push-bar 105 receives the pivot-fastener joining push-bar 105 to the output-arm of first rocker 101 and the output arm of first rocker 101 resides within the slot of push-bar 105. Push-bar 105 is rectangular and roughly of the section of a standard hockey stick. It may be solid or hollow. It may be square or round, elliptic or other shape. It is ideally made from ply or solid woods and may also be constructed of solid or hollow laminated fabric-reinforced resin, fiberglass, aramid, or graphite. The second-end slots may advantageously receive metallic inserts, not shown, to harden the push-bar against contact stresses of abusive operation. Made from woods, the entire external surfaces of the part should be finished with fin-oil or a water repelling varnish.

Figure 30:
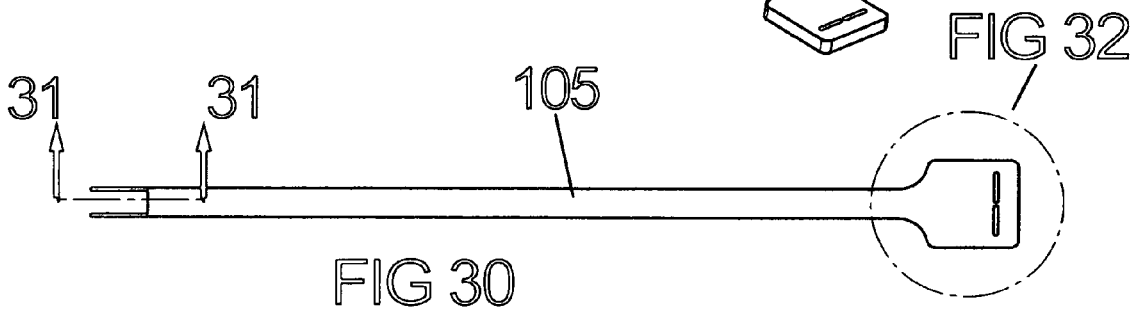

FIG. 30 shows push-bar 105 from a top view perspective, showing the clearance opening at the first end and the aperture. The second end shows a squared-off head and vertical thru-slots connecting the top and bottom surfaces of the head of push-bar 105.

Figure 31:
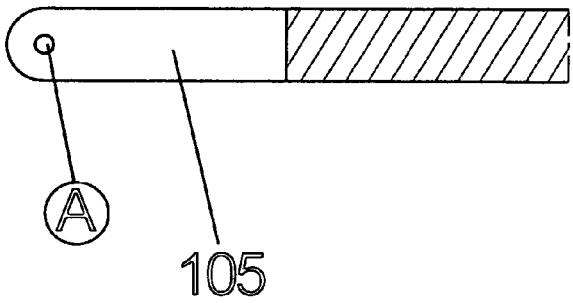

FIG. 31 illustrates push-bar 105 first end in partial section and shows the aperture and the clearance opening of the first end. The apertures can have bushings installed as with all apertures of the system to harden them against abuse.

Figure 32:
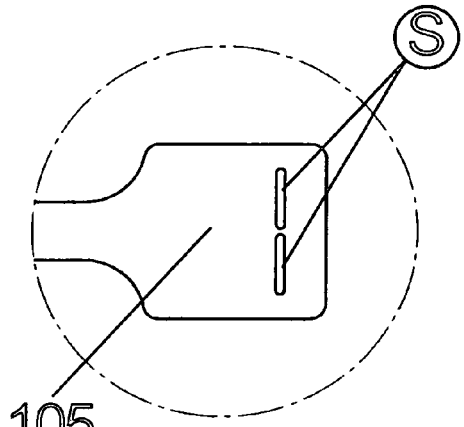

FIG. 32 shows push-bar 105 second end head with vertical thru-slots.

FIG. 33 isometric exploded view of fin-bearing rocker assembly 301 comprised of rocker 107, fin assembly 201 made up of fin 123 and fin-bar 121. Fin assembly 201 assembles to fin-bearing rocker assembly 301 with standard nut and bolt fasteners 69 and 67*n*. Apertures in fin-bearing rocker 107 correspond to and remove-ably receive pivot-fasteners 66*c* and 66*d* to attach fin-bearing rocker 301 to stator-carriage 103 and surfboard 109, and push-bar 105 to make propulsion device 401 assemble into watercraft 501. Fin-bearing rocker assembly 302 is a mirror image of fin-bearing rocker assembly 301 and is made by substituting fin-bearing rocker arm 108 a mirror-image of fin-bearing rocker arm 107 for fin-bearing rocker arm 107. Fin-assembly 201 is used on both 301 and 302. Other fin systems may be substituted for fin-assembly 201. For example, pivotal-hydrofoil fin-assembly 203 may remove-ably replace 201 in both assemblies 301 and 302.

FIGS. 34, 35, and 36 show an isometric view, a top view, and a front view of fin-bearing rocker 107 and its details. Fin-bearing rocker 107 shown has a top surface and a bottom surface, right side surface, left side surface and left taper surface at the aft end fin-bearing rocker 107 has a vertical thru-slot in the aft region and the slot goes from top surface to bottom surface and connects to an aft-facing vertical surface. The slot receives fin-assemblies which may be flexing fins or pivotal hydrofoil fins interchangeably. The fin assemblies are fastened to the fin-bearing rocker 107 thru apertures connecting the right side-surface to the left side-surface and the interior slot surfaces and the aft-facing surface. On the forward right corner of fin-bearing rocker 107, a clevis or horizontal slot connects the forward and right-side surfaces. This slot clears the head of the push-rod 105 when assembled to propulsion device 401. At the forward end of the fin-bearing rocker are two thru apertures connecting the fin-bearing rocker 107 top and bottom surfaces, and in the case of the right aperture, connecting the slot or clevis surfaces. The forward apertures remove ably receive pivot fasteners 66*c* and 66*e* when the fin-bearing rocker is assembled to propulsion device 401. Fin-bearing rocker 108 is a mirror-opposite of fin-bearing rocker 107, and the forward apertures in 108 receive pivot fasteners 66*d* and 66*f* when assembled to device 401. The two fin-bearing rockers, 107 and 108 are fabricate able from natural woods and engineered ply woods and may also be wood or foam core encapsulated with fabric-reinforced resins. Equally, the fin-bearing rockers may be made from commercially available composite-sandwich construction panels of hexagonal ribbon core covered by fabric-reinforced resins. Irrespective of the material choice for fabrication above, standard machining practices are applicable and in the case of woods, simple drilling and routering can make the part. Made from woods such as Teak, Mahogany, or Spruce, the fin-bearing rocker may be treated with fin-oil or other to resist salt-water attack. In the case of commercially available sandwich panels (aka honeycomb panels) the material need merely be drilled, routered and sealed with standard sealing resins to result in a light-weight part. Other shapes, sections, and configurations of the fin-bearing rockers and other modes of manufacture for fin-bearing rockers 107 and 108 will readily occur to those of normal skill in the art.

FIGS. 37 and 38 show fm assembly 201 in top and side view, the fin assembly being comprised of fm 123 and fin-carriage 121. Fin-carriage 121 has apertures for removeably receiving attachment fasteners to fixedly connect fin assembly 201 to fin-bearing rocker 107 to make fin-bearing rocker assembly 301. Fin assembly 201 here can be comprised of a resilient molded fm 123 co-molded to the rigid structural fin-carriage 121.

FIGS. 39, 40, and 41 show pivotal hydrofoil-fin assembly 203 in top view, side view, and bottom view. Pivotal hydrofoil-fin assembly 203 is comprised of fin-carriage 125, hydrofoil-fin 127, and a retainer nut 129 retaining hydrofoil-fin 127 to fin-carriage 125 to make the assembly 203. Hydrofoil-fin carriage 125 has apertures in the attachment portion, and a vertical shaft projecting downward there from and a threaded portion at the bottom which allows retainer-nut 129 to be assembled to the assembly and may itself be retained by many standard means known to those of normal skill in the art. Pivotal hydrofoil-fin assembly 203 is interchangeable with fin assembly 201 in fin-bearing rocker assemblies 301 and 302.

FIG. 42 isometric view shows surfboard 109 with hidden lines showing internal definition; and shows a deck with recess and, an aft hollow in mutual communication and suitable to remove ably receive propulsion device 401. Combining surfboard 109 with propulsion device 401 makes human powered watercraft 501. The surfboard 109 may be roto-molded when fabricated from thermoplastic and may subsequently be filled within the airtight cavity with expanding buoyant foam. It may also be made of hand-shaped foam and covered with fiberglass or graphite reinforced structural resins. The surfboard can be made by many different methods well known to those familiar with the art including build-up construction of wood formers, stringers, and plywood covering; all glued and screwed and then treated with suitable water-occlusive resin. An open hollow surfboard with the hollow open to the sea was originally delineated by the applicant in the '224 patent application filed Oct. 23, 2007. The '224 patent application is incorporated by reference herein and is embodied as surfboard 109, and surfboard 109IL.

FIG. 43 isometric view shows surfboard 109IL which is the same as surfboard 109 except with the addition of integral lugs projecting from the deck and the lugs have transverse horizontal apertures to receive pivot 66*a* bolt, and nut 67*n* and attach to first rocker 101. A preferred embodiment of the human powered watercraft uses surfboard 109IL as the stator for the four-bar movement; surfboard 109IL replaces stator-carriage 103 in that embodiment. Hidden lines are removed for clarity.

FIGS. 44, 45, 46, and 47 show top view, side view, side section view, and bottom view of surfboard 109 showing recess, hollow and pivot-receiving apertures. The pivot-apertures may be molded in or may be drilled after forming of the board. The bottom view of surfboard 109 shows the deck projecting aft beyond the lower surfboard surface. This feature prevents energy losses of the fins of the propulsion device 401 from wastefully piercing the surface and throwing a water-lip during fin oscillations.

FIG. 48 shows schematized pivot position geometry and skeletal dimensions corresponding to the four-bar components of the propulsion device. The left portion of FIG. 48 is in side-perspective while the right portion of FIG. 48 is rotated 90 degrees toward the viewer so to display the push-bar and fin-bar pivot points and their skeletal geometry from bottom-perspective. Points A, B, C, D, E, and F govern the positions of respectively alpha-numbered pivots 66*a*, 66*b*, 66*c*, 66*d*, 66*e*, and 66*f* of the propulsion devices and watercrafts described within this document.

FIG. 49 shows a table of preferred geometries for the device with respect to the pivot positions and the lengths and breadth dimensions of the four-bar components to accommodate the pivot positions illustrated as points A, B, C, D, E, and F in FIG. 48 schematized view. The table further delineates the translational input: output ratios; force input: output ratios, and a common force input of fifty pounds and resulting instantaneous forces within the various components. The input:output ratios are shown varying from a low of 1:8 to as high as 1:4. These ratios are exemplary only and are not intended to limit the scope of the invention but rather to show presently preferred geometries. Those skilled in the art will readily apprehend that the shown cases and indeed others are such that internal stresses for the various components may be kept low and even insignificant with prudent design methods while not onerously exceeding those product dimensions common to and accepted by the market for surfboards. That is to say, the propulsion device may fit within a surfboard and not exceed those envelope dimensions for surfboards which are common, normal, and expected within the surfing community and market for surf boards.

Numerous preferred and alternate embodiments have been discussed; these have been discussed primarily in relation to a surfboard specifically although many other watercraft work equally well and are encompassed herein. Other materials may be substituted for those discussed. Fastening methods may be changed as well without departing from the spirit and scope of the invention. Many other modifications and embodiments of the invention set forth herein will come to mind to one skilled in the art having the benefit of these teachings and associated drawings. For example, in lieu of one push-bar, the propulsion device may have two push-bars, each individually connected to fin-bearing rockers and the two push-bars jointly connecting the output arm of the first rocker. Also, the fins may be attached the fin-bearing rockers with singular horizontal pivot fasteners and so affect auto-retracting fins for shallow-water operations. These and the many other modifications are fully within the spirit and scope of the invention. Accordingly, the scope of the invention is not limited by the disclosed embodiments. Instead, the invention should be determined entirely by reference to the claims that follow.

I claim:

1. A system for propulsion of a watercraft having a deck, the system comprising:

a) a first rocker having an input arm and an output arm; the input arm being substantially above deck and having a handle; and the first rocker being connected to the watercraft by a first pivot;

b) a push-bar connected to the output arm of the first rocker, the push-bar having a first end and a second end;

c) a second rocker having an input arm and an output arm; the input arm of the second rocker connected to said second end of said push-bar; the output arm of the second rocker having a fin; said second rocker being connected to the watercraft by a second pivot.

2. The system of claim 1 further comprised of:

a) a third rocker having an input arm and an output arm; the input arm of the third rocker connected to said second end of said push-bar; the output arm of the third rocker having a fin; said third rocker being connected to the watercraft by a third pivot.

3. The system of claim 1 further comprised of a) an aperture connecting the watercraft deck and a lower watercraft surface;

b) the output arm of the first rocker projecting thru the aperture connecting the watercraft deck and the lower watercraft surface.

4. The system of claim 2 further comprised of:

the second rocker and third rocker being at least partially covered by the deck.

5. The system of claim 1 wherein the first pivot connecting the first rocker to the watercraft is substantially horizontal and substantially abeam the watercraft.

6. The system of claim 1 wherein the second pivot connecting said second rocker to said watercraft is substantially vertical.

7. The system of claim 2 wherein the third pivot connecting said third rocker to said watercraft is substantially vertical.

8. A system for propulsion of a surfboard having a long axis, a deck recess, and an aft hollow, the aft hollow and the recess being in communication, the system comprised of:

a) a first rocker having an input arm and an output arm; the input arm being substantially above the surfboard deck and having a handle; the first rocker being connected to the surfboard by a first pivot;

b) a push-bar connected to the output arm of the first rocker, the push-bar having a first end and a second end; the push-bar substantially residing in the recess, the recess being substantially longitudinal to the long axis of the surfboard;

c) a second rocker having an input arm and an output arm; the input arm connected to said second end of said push-bar; the output arm of the second rocker having a fin; said second rocker being connected to the surfboard by a second pivot.

9. The system of claim 8 further comprised of a) a third rocker having an input arm and an output arm; the input arm connecting said second end of said push-bar; the output arm of the third rocker having a fin; said third rocker being connected to the surfboard by a third pivot.

10. The system of claim 9 wherein the first pivot connecting the first rocker and the surfboard is substantially horizontal and substantially abeam the surfboard; and the second pivot connecting the second rocker and the surfboard is substantially vertical; and the third pivot connecting the third rocker and the surfboard is substantially vertical.

11. A device for the propulsion of human powered watercrafts, the device being adapted to be removeably secured to watercrafts, the device comprised of:

a) a first rocker having an input arm and an output arm; the input arm being positionable above a watercraft deck; said first rocker input arm having a handle; the first rocker connected to a stator-carriage by a first pivot; said first rocker output arm connected to a push bar by a second pivot;

b) said stator-carriage having a first end and a second end; and said first pivot connects said stator-carriage proximate said stator-carriage first end; and said stator-carriage second end is connected to a second rocker by a third pivot;

c) said push bar having a first end and a second end; and said second pivot connects said push bar proximate said first end of said push bar; and said second end of said push bar has a slot engaging said second rocker by a fourth pivot;

d) said second rocker having an input arm and an output arm; said second rocker input arm connecting the fourth pivot; said second rocker output arm having a fin.

12. The device of claim 11 wherein the second rocker having an input arm and an output arm is joined by a third rocker having an input arm and an output arm; the input arm of the third rocker connecting said slot in said push bar second end by a fifth pivot; the output arm of the third rocker having a fin; and said third rocker connecting said stator-carriage second end by a sixth pivot.

13. The device of claim 12 wherein the fins of the second and third rockers are flexible fins.

14. The device of claim 12 wherein the fins of the second and third rockers are pivotable fins.

15. The device of claim 11 installed to a watercraft using a system of removable fasteners to fixedly attach said device to said watercraft.

16. The watercraft of claim 15 wherein the watercraft is a surfboard comprised of:

a) a deck surface upon which a user may stand, a water engaging surface below the deck surface, a right side surface and a left side surface, and, a front surface and an aft surface;

b) a hollow inside the surfboard and proximate an aft portion of the surfboard, the hollow connecting with said aft surface of the surfboard, and, the hollow terminating at a more forward portion of the surfboard;

c) a recess connecting the deck surface of the surfboard and a lower surface of the surfboard, the recess connecting with the hollow, and, the recess having an orientation substantially parallel to a length of the surfboard; and, said first rocker projects substantially above said deck surface; and said stator-carriage, said push-bar, and said second rocker reside substantially within the hollow and recess of the surfboard; and, said system of removable fasteners are comprised of a plurality of bolts and nuts joining the device and the surfboard.

17. The device of claim 12 wherein the first and second pivots are orientated substantially horizontally, and substantially transverse a length of the device; and the third, fourth, fifth, and sixth pivots are orientated substantially vertically; and the fins are orientated substantially vertically.

* * * * *